US008783849B2

(12) United States Patent
Haneda

(10) Patent No.: US 8,783,849 B2
(45) Date of Patent: Jul. 22, 2014

(54) PRINTING METHOD AND PRINTING DEVICE

(75) Inventor: Yuya Haneda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 13/429,562

(22) Filed: Mar. 26, 2012

(65) Prior Publication Data

US 2012/0249702 A1 Oct. 4, 2012

(30) Foreign Application Priority Data

Mar. 28, 2011 (JP) ..... 2011-069521

(51) Int. Cl.
*B41J 2/01* (2006.01)
*B41J 11/00* (2006.01)

(52) U.S. Cl.
CPC ..... *B41J 11/002* (2013.01); *B41J 11/0015* (2013.01)
USPC ..... 347/102

(58) Field of Classification Search
CPC ..... B41J 11/002; B41J 11/0015; B41M 7/00; B41M 7/0072; C09D 11/101
USPC ..... 347/101, 102; 34/406; 257/E21.328; 430/320, 322, 324
See application file for complete search history.

(56) References Cited

U.S. PATENT DOCUMENTS

| | | | | |
|---|---|---|---|---|
| 2004/0077112 | A1* | 4/2004 | Elliott | 438/21 |
| 2005/0196710 | A1* | 9/2005 | Shiroguchi | 430/322 |
| 2006/0158482 | A1* | 7/2006 | Nakamura et al. | 347/45 |
| 2008/0231658 | A1* | 9/2008 | Ishida | 347/41 |
| 2010/0182378 | A1* | 7/2010 | Mitsuzawa | 347/51 |
| 2010/0273333 | A1* | 10/2010 | Kato | 438/795 |
| 2011/0069128 | A1* | 3/2011 | Onishi | 347/102 |
| 2011/0157284 | A1 | 6/2011 | Haneda | |

FOREIGN PATENT DOCUMENTS

| | | | |
|---|---|---|---|
| JP | 11-145314 | A | 5/1999 |
| JP | 2003-080687 | A | 3/2003 |
| JP | 2004-160925 | A | 6/2004 |
| JP | 2008-018561 | A | 1/2008 |
| JP | 2008-194827 | A | 8/2008 |
| JP | 2010-042542 | A | 2/2010 |
| JP | 2011-136272 | A | 7/2011 |
| JP | 2011-152523 | A | 8/2011 |

* cited by examiner

*Primary Examiner* — Manish S Shah
*Assistant Examiner* — Roger W Pisha, II
(74) *Attorney, Agent, or Firm* — Global IP Counselors, LLP

(57) ABSTRACT

A printing method includes: discharging droplets of a liquid curable by active light rays from a nozzle of a discharge head onto a semiconductor device while the semiconductor device is in a heated state; and irradiating the droplets on the semiconductor device using the active light rays.

8 Claims, 8 Drawing Sheets

| Heating Temperature | After Drawing | After Scratch Resistance And Solvent Resistance Testing | Visibility | Scratch Resistance And Solvent Resistance |
|---|---|---|---|---|
| 120°C |  |  | ◎ | ◎ |
| 80°C |  |  | △ | ○ |
| 60°C |  |  | × | △ |
| No Heating |  |  | ◎ | △ |

PRINTING METHOD AND PRINTING DEVICE

CROSS-REFERENCE TO RELATED APPLICATIONS

This application claims priority to Japanese Patent Application No. 2011-069521 filed on Mar. 28, 2011. The entire disclosure of Japanese Patent Application No. 2011-069521 is hereby incorporated herein by reference.

BACKGROUND

1. Technical Field

The present invention relates to a printing method and to a printing device.

2. Related Art

In the marking industry, where laser marking predominates, there has recently been a desire for an alternative technique for IC thinning, based on damage, poor visibility, and other problems. One such alternative technique for laser marking is a technique for coating a recording medium using an ink jet method for dropletizing and discharging a functional liquid, and printing predetermined information on the recording information by solidifying the coated functional liquid. Japanese Laid-Open Patent Publication 2003-80687 discloses a printing device for using an IC chip as a recording medium and printing a serial number, manufacturing company, or other predetermined information on the IC chip.

As an application of such marking, attention has also turned to ink jet devices for using an ultraviolet-curable ink, which is curable by being irradiated with ultraviolet rays, to record through an ink jet method. Ultraviolet-curable inks, in curing extremely slowly until irradiated with ultraviolet rays, and curing rapidly once irradiated with ultraviolet rays, have preferable characteristics as printing inks. Another advantage is that the environmental impact is small, because no solvent is volatilized during the curing.

Ultraviolet-curable inks, depending on the composition of the vehicle, are also readily bonded to various different recording media. Ultraviolet-curable inks are also chemically safe, highly adherable, highly resistant to chemical agents, highly weather-resistant, and highly friction-resistant, and are also able to withstand an outdoor environment, among other excellent characteristics. For this reason, in addition to paper, resin film, metal foil, and other thin sheet-shaped recording media, an image can be formed on labeling surfaces, textile products, and other surfaces having a certain degree of three-dimensional shape.

In the marking of IC chips, favorable visibility of characters as well as scratch resistance and solvent resistance are desirable. In, for example, Japanese Laid-Open Patent Publication 11-145314, an IC chip to be marked is irradiated with activation light, which enhances wettability, with the purpose of enhancing scratch resistance and solvent resistance.

SUMMARY

However, the following problems do exist in the prior art described above.

When an IC chip undergoes treatment using activation light, as described above, for enhancing wettability, the close adhesion between the chip surface and the functional liquid is enhanced, but the pre-curing monomers contained in the ink seep into the IC chip due to the enhanced wettability and due to the unevenness of the chip surface, thus worsening the quality of the marking, which is a concern.

The present invention has been contrived in view of such circumstances, and addresses the problem of providing a printing method and printing device for obtaining excellent scratch resistance and solvent resistance as well as favorable printing quality.

To resolve the aforesaid problems, a printing method according to one aspect of the present invention includes: discharging droplets of a liquid curable by active light rays from a nozzle of a discharge head onto a semiconductor device while the semiconductor device is in a heated state; and irradiating the droplets on the semiconductor device using the active light rays.

According to the printing method of the present invention, because the droplets are discharged onto a heated semiconductor device, the landed droplets will have reduced viscosity and thus will spread out favorably on the semiconductor device. At such a time, when the semiconductor is heated to, for example, the boiling point of the droplet monomers or higher, the monomers of the droplets spread out on the semiconductor device can be volatilized. Accordingly, as will be illustrated by results described below, printing can be performed with excellent scratch resistance and solvent resistance as well as favorable quality in which there is less bleeding.

In the printing method described above, the discharging of the droplets preferably includes discharging the droplets onto the semiconductor device while the semiconductor device is heated to at least 80° C.

According to such a configuration, because the semiconductor device is heated to at least 80° C., the close adhesion between the semiconductor device and the film formed by the droplets can be modified.

In the printing method described above, the discharging of the droplets preferably includes discharging the droplets onto the semiconductor device while the semiconductor device is heated to at least 120° C. or higher in the discharge step.

According to such a configuration, because the semiconductor device is heated to at least 120° C., the monomers of the droplets spread out on the semiconductor device can be reliably volatilized.

The printing method described above preferably further includes, prior to the discharging of the droplets, performing a surface treatment of the semiconductor device by irradiating the semiconductor device with ultraviolet rays.

A printing device according to another aspect of the present invention includes a discharge head, a heating unit and an irradiation unit. The discharge head has a nozzle for discharging, onto a semiconductor device, droplets of a liquid curable by active light rays. The heating unit is configured and arranged to heat the semiconductor device when the droplets are discharged onto a surface of the semiconductor device from the nozzle of the discharge head. The irradiation unit is configured and arranged to irradiate, using the active light rays, the droplets discharged onto the semiconductor device.

According to the printing device of the present invention, because the droplets are discharged onto a semiconductor device heated by the heating unit, the landed droplets will have decreased viscosity and will spread out favorably on the semiconductor device. At such a time, when the semiconductor device is heated to, for example, the boiling point of the monomers in the droplets, the monomers in the droplets having spread out on the semiconductor device can be volatilized. Accordingly, as will be illustrated by results described below, printing can be performed with excellent scratch resistance and solvent resistance as well as favorable quality in which there is less bleeding.

In the aforesaid printing device, the heating unit is preferably configured and arranged to heat the semiconductor device to at least 80° C.

According to such a configuration, because the semiconductor device is heated to at least 80° C., the close adhesion between the semiconductor device and the film formed by the droplets can be modified.

In the aforesaid printing device, the heating unit is preferably configured and arranged to heat the semiconductor device to at least 120° C.

According to such a configuration, because the semiconductor device is heated to at least 120° C., the monomers of the droplets spread out on the semiconductor device can be reliably volatilized.

The aforesaid printing device preferably further includes a surface treatment unit configured and arranged to irradiate the semiconductor device with ultraviolet rays to perform a surface treatment of the semiconductor device.

BRIEF DESCRIPTION OF THE DRAWINGS

Referring now to the attached drawings which form a part of this original disclosure.

DETAILED DESCRIPTION OF EXEMPLARY EMBODIMENTS

The following is a description of modes for carrying out the printing device of the present invention, with reference to the accompanying drawings.

The following embodiment of implementation is meant to illustrate one aspect of the present invention and not to limit the present invention; any desired change to the present invention within the technical scope of the spirit thereof is possible. Also, to facilitate understanding of each of the configurations, the following drawings have different scales, numbers, and other parameters for each of the structures from the actual structures.

An example of a printing device and of a printing method for printing by using the printing device to discharge droplets, being features of the present invention, shall be described in this embodiment with reference to FIGS. 1 to 9.

Semiconductor Substrate

First, a semiconductor substrate, which is an example of an object to be drawn (printed) on with a printing device, shall now be described.

Figure 1A:
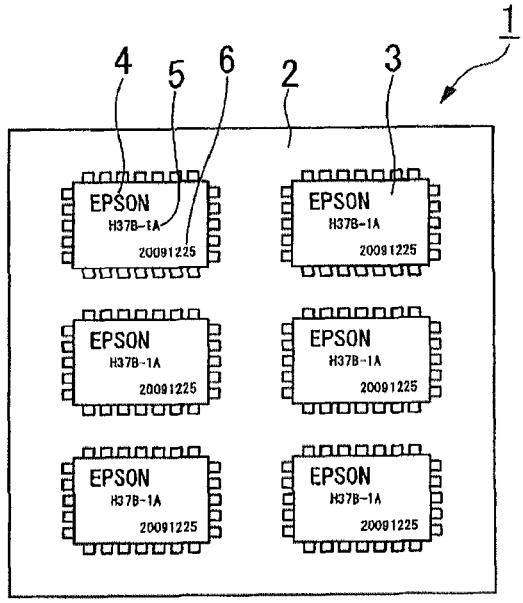
FIG. 1A is a schematic plan view illustrating a semiconductor substrate.

FIG. 1A is a schematic plan view illustrating a semiconductor substrate. As illustrated in FIG. 1A, a semiconductor substrate 1 serving as a base material is provided with a substrate 2. The substrate 2 may be heat-resistant and may allow for the installation of a semiconductor device 3; a glass epoxy substrate, phenolic paper substrate, epoxy paper substrate, or the like can be used as the substrate 2.

The semiconductor device 3 is installed onto the substrate 2. The semiconductor device 3 formed on the substrate 2 in the semiconductor substrate 1 is covered by a mold layer composed of a resin that contains epoxy. A company name mark 4, a model code 5, a serial number 6, and other marks (printing patterns or predetermined patterns) are drawn on the semiconductor device 3. These marks are drawn on by the printing device. These marks are therefore drawn onto the mold layer formed on the surface of the semiconductor device 3.

Printing Device

Figure 1B:
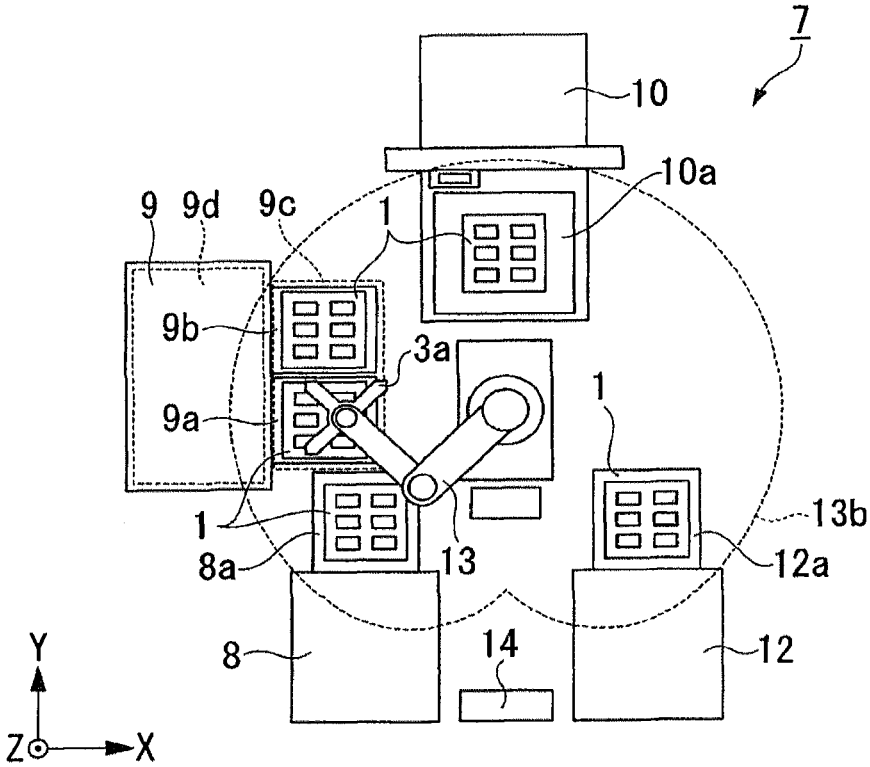
FIG. 1B is a schematic plan view illustrating a liquid droplet discharge device.

FIG. 1B is a schematic plan view illustrating a printing device.

As illustrated in FIG. 1B, a printing device 7 is primarily constituted of a supply unit 8, a pre-treatment unit (surface treatment unit) 9, a coating unit (printing unit) 10, a housing unit 12, a transport unit 13, and a controller 14. The printing device 7 has the supply unit 8, the pre-treatment unit 9, the coating unit 10, the housing unit 12, and the controller 14 disposed, in the stated order, clockwise around the transport unit 13. The supply unit 8 is also disposed adjacent to the controller 14. The direction in which the supply unit 8, the controller 14, and the housing unit 12 form a line serves as an X direction. The direction orthogonal to the X direction serves as a Y direction; the coating unit 10, the transport unit 13, and the controller 14 are disposed lined up in the Y direction. The vertical direction serves as a Z direction.

The supply unit 8 is provided with a housing container in which a plurality of semiconductor substrates 1 are housed. The supply unit 8 is also provided with a relay point 8*a*, the semiconductor substrates 1 being supplied to the relay point 8*a* from the housing container.

The pre-treatment unit 9 has the function of modifying while also heating the surface of the semiconductor device 3. The spreading conditions of the discharged droplets and the close adhesion of the printed marks are adjusted on the semiconductor device 3 by the pre-treatment unit 9. The pre-treatment unit 9 is provided with a first relay point 9*a* and a second relay point 9*b*, and takes in the pre-treatment semiconductor substrate 1 from the first relay point 9*a* or the second relay point 9*b* and modifies the surface. Thereafter, the pre-treatment unit 9 moves the post-treatment semiconductor substrate 1 to either the first relay point 9*a* or the second relay point 9*b*, and places the semiconductor substrate 1 on standby. The first relay point 9*a* and the second relay point 9*b* are combined to make a relay point 9*c*. When pre-treatment is being performed within the pre-treatment unit 9, the point at which the semiconductor substrate 1 is located is a treatment point 9*d*.

The coating unit 10 discharges droplets onto the semiconductor device 3 to draw (print) a mark, and has a function for either solidifying or curing the mark having been drawn. The coating unit 10 is provided with a relay point 10*a*, and moves the pre-drawing semiconductor substrate 1 from the relay point 10*a* to perform a drawing treatment and a curing treatment. Thereafter, the coating unit 10 moves the post-drawing semiconductor substrate 1 to the relay point 10*a*, and places the semiconductor substrate 1 on standby.

The housing unit 12 is provided with a housing container capable of housing a plurality of semiconductor substrates 1. The housing unit 12 is also provided with a relay point 12*a*, and houses the semiconductor substrate 1 in the housing container from the relay point 12*a*. An operator discharges, from the printing device 7, the housing container in which the semiconductor substrates 1 are housed.

The transport unit 13 is arranged at a point in the middle of the printing device 7. A scalar-type robot provided with two arm parts is used as the transport unit 13 Gripping units 13*a* for gripping the semiconductor substrate 1 are installed at the tips of the arm parts. The relay points 8*a*, 9*c*, 10*a*, 12*a* are located inside a moving range 13*b* of the gripping units 13*a*. Accordingly, the gripping units 13*a* are able to move the semiconductor substrate 1 between the relay points 8*a*, 9*c*, 10*a*, 12*c*. The controller 14 is a device for controlling the operation of the entire printing device 7, and manages the operating status of each of the parts of the printing device 7. An instruction signal for moving the semiconductor substrate 1 is outputted to the transport unit 13. The semiconductor substrate 1 is thereby made to pass through each of the parts in sequence and be drawn on.

The following is a more detailed description of each of the parts.

Supply Unit

Figure 2A:
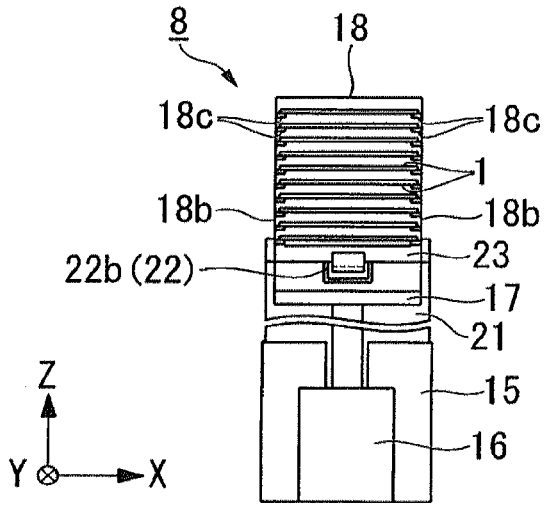
FIGS. 2A to 2C are schematic views illustrating a supply unit.
Figure 2B:
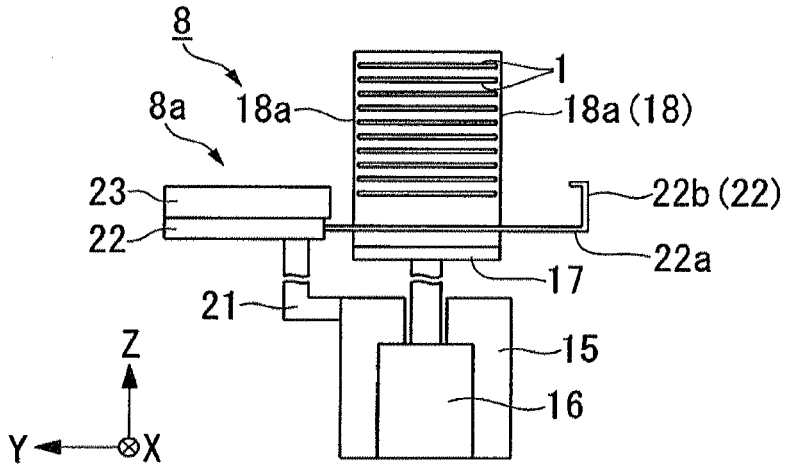
Figure 2C:
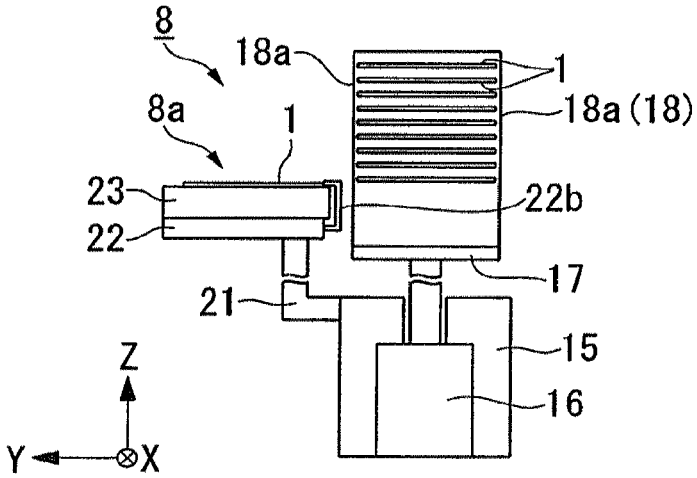

FIG. 2A is a schematic front view illustrating the supply unit, and FIGS. 2B and 2C are schematic side views illustrating the supply unit. As illustrated in FIGS. 2A and 2B, the supply unit 8 is provided with a base stage 15. A vertical motion device 16 is installed inside the base stage 15. The vertical motion device 16 is provided with a linear movement mechanism for operating in the Z direction. As the linear movement mechanism, it is possible to use a combination of a ball screw and a rotary motor, a combination of a hydraulic cylinder and an oil pump, or other mechanism. This embodiment employs a mechanism which operates by a ball screw and a step motor, by way of example. A vertical movement plate 17 is installed on the upper side of the base stage 15 so as to be in contact with the vertical motion device 16. The vertical movement plate 17 can be moved vertically by the vertical motion device 16 only by a predetermined degree of travel.

A cuboid housing container 18 is installed on top of the vertical movement plate 17, a plurality of semiconductor substrates 1 being housed within the housing container 18. The housing container 18 has opening parts 18*a* formed on both surfaces in the Y direction, allowing for the removal and insertion of the semiconductor substrate 1 from the opening parts 18*a*. Convex rails 18*c* are formed inside side surfaces 18*b* located on both sides of the X direction of the housing container 18, the rails 18*c* being arranged so as to extend in the Y direction. The rails 18*c* are arrayed in a plurality of equally spaced intervals in the Z direction. The semiconductor substrates 1 are inserted from either the Y direction or the −Y direction along the rails 18*c*, whereby the semiconductor substrates 1 are housed in an array in the Z direction.

A substrate withdrawer 22 and a relay stage 23 are installed via a supporter material 21 in the Y direction side of the base stage 15. The relay stage 23 is arranged so as to overlap the substrate withdrawer 22 in the case of the Y direction side of the housing container 18. The substrate withdrawer 22 is provided with an arm part 22*a* which stretches in the Y direction, and a linear movement mechanism for driving the arm part 22*a*. The linear movement mechanism is not particularly limited, provided that the linear movement mechanism be a mechanism for moving in a linear manner; the present embodiment employs an air cylinder operated by compressed air, by way of example. A claw part 22*b* bent in a substantially rectangular manner is installed at one end of the arm part 22*a*, the tip of the claw part 22*b* being formed so as to be parallel with the arm part 22*a*.

The substrate withdrawer 22 stretches the arm part 22*a*, whereby the arm part 22*a* penetrates the housing container 18. Then, the claw part 22*b* moves to the −Y direction side of the housing container 18. Next, after the vertical motion device 16 lowers the semiconductor substrate 1, the substrate withdrawer 22 contracts the arm part 22*a*. At such a time, the claw part 22*b* moves while pushing one end of the semiconductor substrate 1.

As a result, as illustrated in FIG. 2C, the semiconductor substrate 1 is made to move over the relay stage 23 from the housing container 18. The relay stage 23 has a concave part formed to have substantially the same width as the width in the X direction of the semiconductor substrate 1, the semiconductor substrate 1 being moved along the concave part. The position in the X direction of the semiconductor substrate 1 is determined by the concave part. The position in the Y direction of the semiconductor substrate 1 is determined by the point where the semiconductor substrate 1 is halted, pushed by the claw part 22*b*. The relay point 8*a* is on top of the relay stage 23, and the semiconductor substrate 1 is put on standby at a predetermined point of the relay point 8*a*. When the semiconductor substrate 1 is put on standby at the relay point 8*a* of the supply unit 8, the transport unit 13 moves the gripping unit 13*a* to the point facing opposite the semiconductor substrate 1 and moves gripping the semiconductor substrate 1.

After the semiconductor substrate 1 is moved from above the relay stage 23 by the transport unit 13, the substrate withdrawer 22 stretches out the arm part 22*a*. Next, the vertical motion device 16 lowers the housing container 18, and the substrate withdrawer 22 moves the semiconductor substrate 1 over the relay stage 23 from within the housing container 18. In this manner, the supply unit 8 moves the semiconductor substrates 1 in sequence from the housing container 18 onto the relay stage 23. After all of the semiconductor substrates 1 within the housing container 18 have been moved onto the relay stage 23, the operator switches the housing container 18, which is now empty, with a housing container 18 in which semiconductor substrates 1 are housed. The semiconductor substrates can thereby be supplied to the supply unit 8.

Pre-Treatment Unit

Figure 3A:
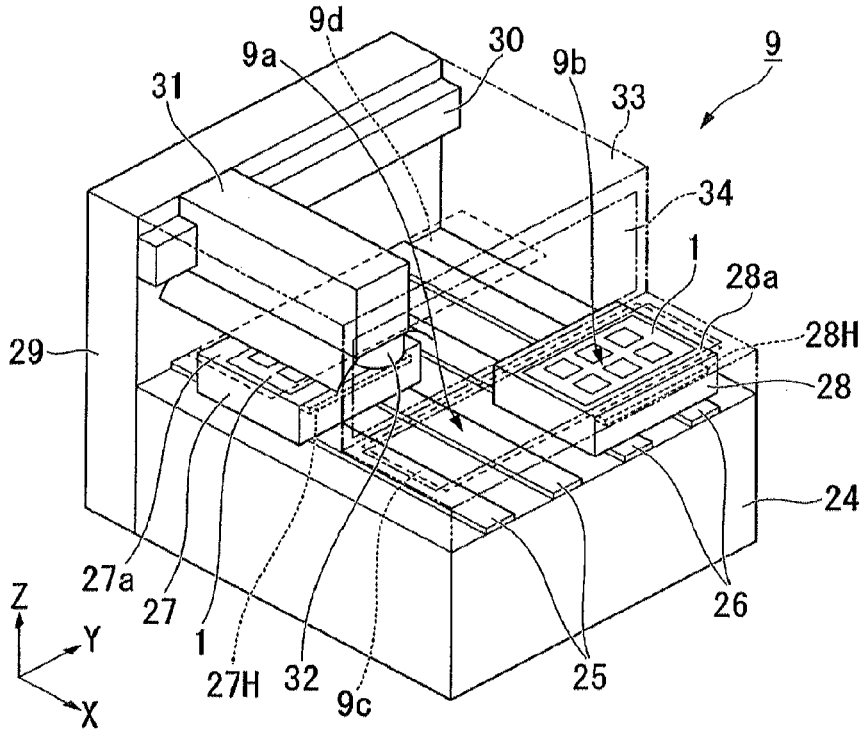
FIGS. 3A and 3B are schematic perspective views illustrating a configuration of a pre-treatment unit.
Figure 3B:
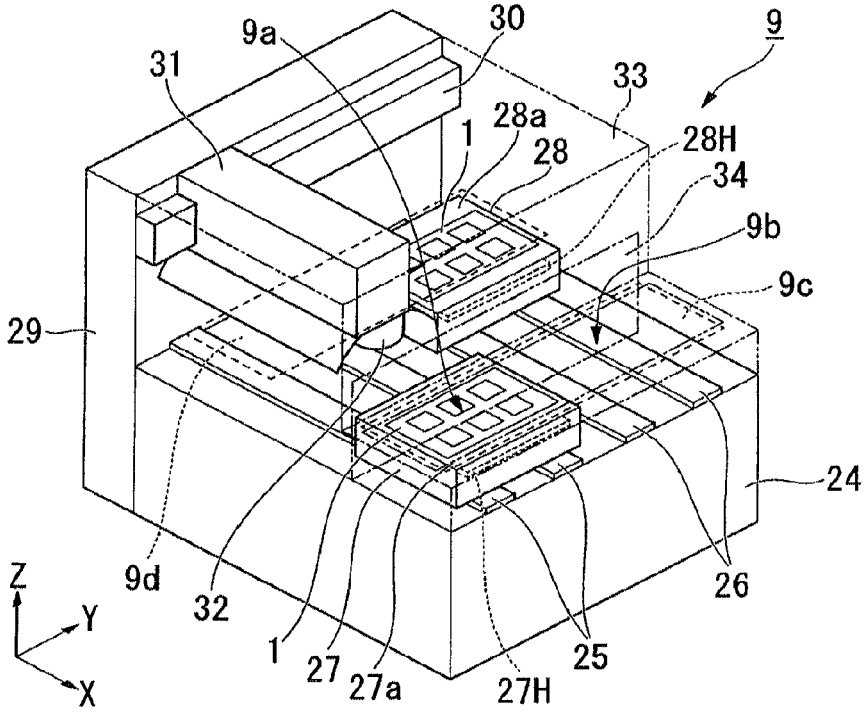

FIGS. 3A and 3B are schematic perspective views illustrating the configuration of the pre-treatment unit. As illustrated in FIG. 3A, a pre-treatment unit 9 is provided with a base stage 24, and a pair of a first guide rail 25 and a second guide rail 26 are installed in a series each extending in the X direction on the base stage 24. A first stage 27 serving as a mounting stage which moves reciprocatingly in the X direction along the first guide rail 25 is installed on the first guide rail 25, and a second stage 28 serving as a mounting stage which moves reciprocatingly in the X direction along the second guide rail 26 is installed on the second guide rail 26. The first stage 27 and the second stage 28 are provided with a linear movement mechanism and are able to move reciprocatingly. As the linear movement mechanism, it is possible to use, for example, a mechanism similar to the linear movement mechanism provided to the vertical motion device 16.

A mounting surface 27*a* is installed on the upper surface of the first stage 27, and a suction-type chucking mechanism is formed on the mounting surface 27*a*. The transport unit 13 mounts the semiconductor substrate 1 onto the mounting surface 27*a* and thereafter causes the chucking mechanism to operate, whereby the pre-treatment unit 9 is able to secure the semiconductor substrate 1 to the mounting surface 27*a*. Similarly, a mounting surface 28*a* is also installed on the upper surface of the second stage 28, and a suction-type chucking mechanism is formed on the mounting surface 28*a*. The transport unit 13 mounts the semiconductor substrate 1 onto the mounting surface 28*a* and thereafter causes the chucking mechanism to operate, whereby the pre-treatment unit 9 is able to secure the semiconductor substrate 1 to the mounting surface 28*a*.

A heating device 27H is built into the first stage 27, and heats the semiconductor substrate 1, having been mounted onto the mounting surface 27*a*, to a predetermined temperature while being controlled by the controller 14. Similarly, a heating device 28H is built into the second stage 28, and heats the semiconductor substrate 1, having been mounted onto the mounting surface 28*a*, to a predetermined temperature while being controlled by the controller 14.

A point on the mounting surface 27*a* when the first stage 27 is arranged on the X direction side serves as a first relay point 9*a*, and a point on the mounting surface 28*a* when the second stage 28 is arranged on the X direction side serves as a second relay point 9*b*. A relay point 9*c*, being the first relay point 9*a* and the second relay point 9*b*, is positioned within the operating range of the gripping units 13*a*; the mounting surface 27*a* and the mounting surface 28*a* are exposed at the relay point 9*c*. Accordingly, the transport unit 13 is readily able to mount the semiconductor substrate 1 onto the mounting surface 27*a* and the mounting surface 28*a*. After the semiconductor substrate 1 has been pre-treated, the semiconductor substrate 1 is put on standby over the mounting surface 27*a* positioned at the first relay point 9*a* or over the mounting surface 28*a* positioned at the second relay point 9*b*. Accordingly, the gripping units 13*a* of the transport unit 13 are readily able to move gripping the semiconductor substrate 1.

A planar support unit 29 is assembled in the −X direction of the base stage 24. A guide rail 30 extending in the Y direction is installed on the upper side on the surface in the X direction side of the support unit 29. Also, a carriage 31 which moves along the guide rail 30 is installed at a point facing opposite the guide rail 30. The carriage 31 is provided with a linear movement mechanism, and is able to move reciprocatingly. As the linear movement mechanism, it is possible to use, for example, a mechanism similar to the linear movement mechanism provided to the vertical motion device 16.

A treatment unit 32 is installed at the base stage 24 side of the carriage 31. Illustrative examples of the treatment unit 32 can include a low-pressure mercury lamp for emitting activation light rays, a hydrogen burner, an excimer laser, plasma discharge unit, corona discharge unit, or the like. In the case where a mercury lamp is used, the semiconductor substrate 1 is irradiated with ultraviolet light, whereby the liquid repellency of the surface of the semiconductor substrate 1 can be modified. In the case where a hydrogen burner is used, the oxidized surface of the semiconductor surface 1 can be partially reduced, the surface being thus roughened. In the case where an excimer laser is used, the surface of the semiconductor substrate 1 can be partially molten and solidified, and is thus roughened. In the case where plasma discharge or corona discharge is used, the surface of the semiconductor substrate 1 can be mechanically ground, and is thus roughened. The present embodiment employs a mercury lamp, by way of example.

The pre-treatment unit 9 also reciprocatingly conveys the carriage 31 while also irradiating with ultraviolet light from a low-pressure mercury lamp 32 in a state where the semiconductor substrate 1 has been heated by the heating devices 27H, 28H. The pre-treatment unit 9 is thereby enabled to irradiate a broad range of the treatment point 9*d* with ultraviolet light.

The temperature by which the aforesaid heating devices 27H, 28H heat the semiconductor substrate 1 is preferably able to effectively modify the surface of the semiconductor substrate 1 and is preferably no greater than the heat resistance temperature of the semiconductor substrate 1. In the present embodiment, the semiconductor substrate 1 is set to 120° C., by way of example.

The pre-treatment unit 9 is entirely covered by an outer covering part 33. A door part 34 which can move up and down is installed in the interior of the outer covering part 33. Also, as illustrated by FIG. 3B, the door part 34 is lowered after the first stage 27 or the second stage 28 has moved to a point facing opposite the carriage 31. The ultraviolet light irradiated by the low-pressure mercury pump 32 is thereby prevented from leaking outside of the pre-treatment unit 9.

When either the mounting surface 27*a* or the mounting surface 28*a* is located at the relay point 9*c*, the transport unit feeds the semiconductor substrate 1 to the mounting surface 27*a* and the mounting surface 28*a*. The first stage 27 or second stage 28 on which the semiconductor substrate 1 is mounted is then moved to the treatment point 9*d*, where pre-treatment is performed by the pre-treatment unit 9. After the pre-treatment has been completed, the pre-treatment unit 9 moves the first stage 27 or the second stage 28 to the relay point 9*c*. Subsequently, the transport unit 13 removes the semiconductor substrate 1 from the mounting surface 27*a* or the mounting surface 28*a* for transport to the coating unit 10, described below.

Coating Unit

The following is a description of the coating unit 10 for discharging droplets onto the semiconductor substrate 1 to form a mark, with reference to FIGS. 4 and 5. The device for discharging the droplets is any of various types of devices, but a device which uses an ink jet method is preferable. The ink jet method is capable of discharging minute droplets and is therefore suited for fine processing.

Figure 4A:
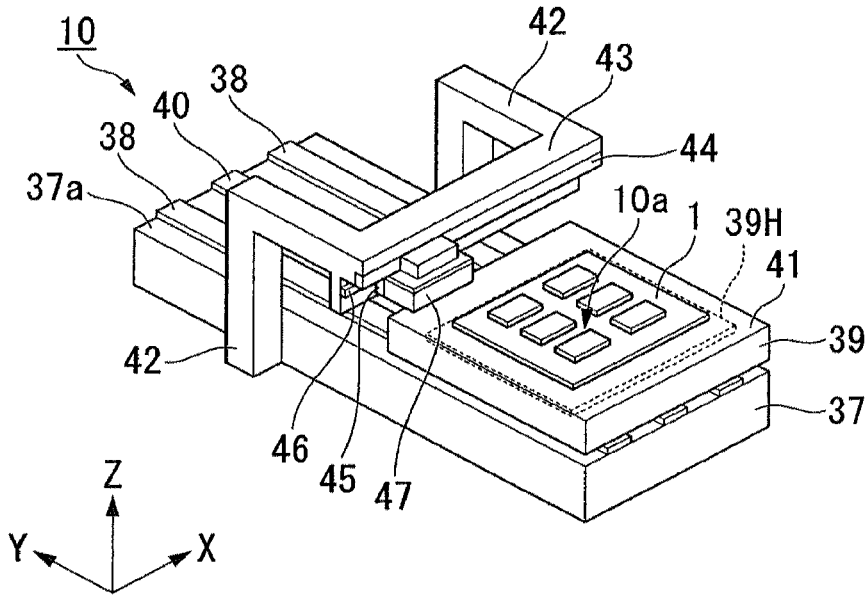
FIG. 4A is a schematic perspective view illustrating a coating unit.

FIG. 4A is a schematic perspective view illustrating the configuration of the coating unit. Droplets are discharged onto the semiconductor substrate 1 by the coating unit 10. As illustrated in FIG. 4A, a base stage 37 formed in a cuboid shape is provided to the coating unit 10. The primary scanning direction when droplets are being discharged is the direction in which the liquid droplet discharge head moves relative to the printing medium. A secondary scanning direction is the direction orthogonal to the primary scanning direction. When a new line is started, the secondary scanning direction is the direction in which the liquid droplet discharge head moves relative to the printing medium. In the present embodiment, the primary scanning direction is the X direction, and the secondary scanning direction is the Y direction.

A pair of guide rails 38 extending in the Y direction are provided to the upper surface 37*a* of the base stage 37, the guide rails 38 being convex over the entire width of the Y direction. A stage 39 provided with a linear movement mechanism (not shown) corresponding to the pair of guide rails 38 is attached to the upper side of the base stage 37. As the linear movement mechanism of the stage 39, it is possible to use a linear motor, a screw-type linear movement mechanism, or the like. The present embodiment employs a linear motor, by way of example. The mechanism moves forward or backward at a predetermined speed along the Y direction. The repetition of forward and backward motion is referred to as scanning motion. A secondary scanning position detection device 40 is arranged in parallel with the guide rails 38 on the upper surface 37*a* of the base stage 37, the position of the stage 39 being detected by the secondary scanning position detection device 40.

A mounting surface 41 is formed on the upper surface of the stage 39, and a suction-type substrate chucking mechanism (not shown) is provided to the mounting surface 41. After the semiconductor substrate 1 is mounted onto the mounting surface 41, the semiconductor substrate 1 is secured to the mounting surface 41 by the substrate chucking mechanism.

A point on the mounting surface 41 when the stage 39 is positioned in the −Y direction serves as a relay point 10*a*. The mounting surface 41 is installed so as to be exposed within the operating range of the gripping units 13*a*. Accordingly, the transport unit 13 is readily able to mount the semiconductor substrate 1 onto the mounting surface 41. After the semiconductor substrate 1 has been coated, the semiconductor substrate 1 is put on standby on the mounting surface 41, being the relay point 10*a*. Accordingly, the gripping units 13*a* of the transport unit 13 are readily able to move gripping the semiconductor substrate 1.

A heating device 39H is built into the stage 39 and heats the semiconductor substrate 1, having been mounted onto the mounting surface 41, to a predetermined temperature while being controlled by the controller 14. The temperature at which the aforesaid heating device 39H heats the semiconductor substrate 1 is preferably no greater than the heat resistance temperature of the semiconductor substrate 1, a range being 80° C. to 300° C., and is more preferably set to the range of 100° to 300° C. In the present embodiment, the semiconductor substrate 1 is set to 120° C., which is the same temperature as the heating devices 27H, 28H of the pre-treatment unit 9. The heating device 39H heats the mounting surface 41 at 120° C. prior to the semiconductor substrate 1 being mounted onto the mounting surface 41 by the transport unit 13.

In this manner, the mounting surface 41 of the stage 39 is heated by the heating device 39H at 120° C., the same as the heating temperature in the pre-treatment unit 9, whereby the present embodiment allows for the coating process to be carried out on the mounting surface 41 while the temperature of the semiconductor substrate 1 remains held. Herein, the functional liquid discharged from a nozzle of the liquid droplet discharge head 49, as will be described below, has a decreased viscosity when the semiconductor substrate 1, and therefore the discharged functional liquid can be favorably spread out on the surface of the semiconductor substrate 1 (the semiconductor device 3). In the present embodiment, the semiconductor substrate 1 onto which the ink lands is heated at 120° C., which is a higher temperature than the boiling point of the monomers contained in the ink (described below), and therefore the monomers can be prevented from seeping out into the semiconductor device 3 when the monomers are volatilized, and, as illustrated in results described below, a mark having favorable printing quality can be drawn onto the semiconductor device 3.

A pair of support stages 42 are assembled on both sides in the X direction of the base stage 37, and a guide member 43 extending in the X direction is constructed on the pair of support stages 42. Guide rails 44 extending in the X direction are provided to the lower side of the guide member 43, the guide rails 44 being convex over the entire width of the X direction. A carriage (moving means) 45 attached so as to be able to move along the guide rails 44 is formed in a substantially cuboid shape. The carriage 45 is provided with a linear movement mechanism; as the linear movement mechanism, a mechanism similar to the linear movement mechanism provided to the stage 39 can be used. The carriage 45 moves scanning along the X direction. A primary scanning position detection device 46 is arranged between the guide member 43 and the carriage 45, and the position of the carriage 45 is measured. Specifically, the present embodiment uses a linear encoder as the primary scanning position detection device 46. The primary scanning position detection device is electrically connected to the controller 14 and transmits measurement results to the controller 14. A head unit 47 is installed on the lower side of the carriage 45, and a convex liquid droplet discharge head (not shown) is provided to the surface of the head unit 47 on the stage 39 side.

Figure 4B:
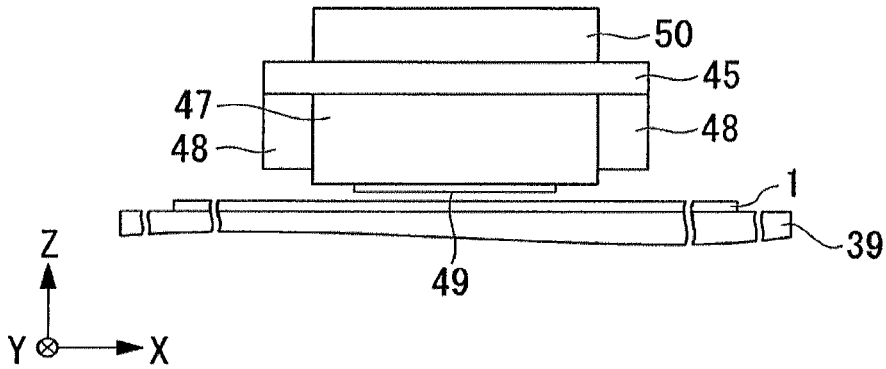
FIG. 4B is a schematic side view illustrating a carriage.

FIG. 4B is a schematic side view illustrating a carriage. As illustrated in FIG. 4B, the head unit 47 and a pair of curing units (irradiation units) 48 serving as irradiation units are arranged on the semiconductor substrate 1 side of the carriage 45. A convex liquid droplet discharge head (discharge head) 49 for discharging droplets is provided to the semiconductor substrate 1 side of the head unit 47.

An irradiation device for irradiating with ultraviolet light, which causes the discharged droplets to be cured, is arranged on the interior of the curing unit 48s. The curing units 48 are arranged on positions on both sides surrounding the head unit 47 in the primary scanning direction (the relative movement direction). The irradiation device is constituted of a light-emitting unit and a heatsink or the like. A plurality of light emitting diode (LED) elements are installed in series on the light-emitting unit. The LED units are elements supplied with electrical power to emit ultraviolet light, which is light in the ultraviolet range.

A housing tank 50 is arranged on the upper side of the carriage 45 as shown, and ink (the functional liquid) is housed in the housing tank 50. The liquid droplet discharge head 49 and the housing 50 are connected by a tube (not shown), and the ink inside the housing tank 50 is supplied to the liquid droplet discharge head 49 via the tube. The temperature of the ink being discharged from the liquid droplet discharge head 49 is preferably from room temperature to 40° C.

Herein, a description of the ink being discharged from the liquid droplet discharge head 49 shall now be provided.

This embodiment relates to an ink composition for a radiation curing ink jet.

The ink composition contains predetermined respective amounts of N vinyl caprolactam and a vinyl ether group-containing (meth)acrylic acid ester (hereinafter, "monomer A") represented by the following General Formula I:

$$CH_2{=}CR^1{-}COOR^2{-}O{-}CH{=}CH{-}R^3 \quad (I)$$

(in the formula, $R^1$ is a hydrogen atom or a methyl group; $R^2$ is a $C_{2-20}$ divalent organic residue; and $R^3$ is a hydrogen atom or a $C_{1-11}$ monovalent organic residue).

The following is a description of the additives (components) which the ink composition of the present embodiment either contains or can contain.

Polymerizable Compounds

The polymerizable compounds contained in the ink composition of the present embodiment are polymerized upon being irradiated with light by the action of a photo polymerization initiator described below, and are capable of causing the imprinted ink to be cured.

Monomer A

The monomer A, which is a polymerizable compound required in the present embodiment, is a compound the molecule of which has both a vinyl group and a (meth) acrylic group, and is represented by the above General Formula I.

Having the ink composition contain the monomer A makes it possible for the ink to be favorably cured, among other effects.

In the above General Formula I, it is suitable for the divalent organic residue represented by $R^2$ to be: a $C_{2-20}$ linear, branched, or cyclic alkylene group; a $C_{2-20}$ alkylene group structured to have an oxygen atom due to at least one of either an ether bond and an ester bond; or an optionally substituted $C_{6-11}$ divalent aromatic group. Of these, it is suitable to use: an ethylene group, an n-propylene, an isopropylene group, a butylene group, or another $C_{2-6}$ alkylene group; or an oxyethylene group, an oxy-n-propylene group, an oxy-isopropylene group, an oxybutylene group, or another $C_{2-9}$ alkylene group structured to have an oxygen atom due to an ether bond.

In the above General Formula I, it is suitable for the $C_{1-11}$ monovalent organic residue represented by $R^3$ to be: a $C_{1-10}$ linear, branched, or cyclic alkylene group; or an optionally substituted $C_{6-11}$ aromatic group. Of these, it is suitable to use a: $C_{1-2}$ alkyl group that is a methyl group or an ethyl group; or a phenyl group, a benzyl group, or another $C_{6-8}$ aromatic group.

In the case where an aforesaid organic residue is an optionally substituted group, the substituent(s) are divided into groups containing carbon atoms and groups not containing a carbon atom. Firstly, in the case where the aforesaid substituent is a group containing a carbon atom, the carbon atom is counted in the carbon number of the organic residue. Examples of groups containing carbon atoms include but are not limited to a carboxyl group and an alkoxy group. Next, examples of groups not containing carbon atoms include but are not limited to a hydroxyl group and a halo group.

Specific examples of the monomer A represented by the above General Formula I include, but are not specifically limited to: 2-(vinyloxy)ethyl(meth)acrylate, 3-(vinyloxy) ethyl(meth)acrylate, 1-methyl-2-(vinyloxy)ethyl(meth)acrylate, 2-(vinyloxy) propyl(meth)acrylate, 4-(vinyloxy)butyl(meth)acrylate,1-methyl-3-(vinyloxy)propyl(meth)acrylate, 1-(vinyloxy)methyl propyl(meth)acrylate, 2-methyl-3-(vinyloxy)propyl (meth)acrylate, 1,1-dimethyl-2-(vinyloxy)ethyl(meth) acrylate),3-(vinyloxy)butyl(meth)acrylate, 1-methyl-2-(vinyloxy)propyl(meth)acrylate, 2-(vinyloxy)butyl(meth) acrylate, 4-vinyloxy)cyclohexyl(meth)acrylate, 5-(vinyloxy) pentyl(meth)acrylate, 6-(vinyloxy)hexyl(meth)acrylate), 4-(vinyloxy)methyl cyclohexyl methyl(meth)acrylate, 3-(vinyloxy)methyl cyclohexyl methyl(meth)acrylate, 2-(vinyloxy)methyl cyclohexyl methyl(meth)acrylate, p-(vinyloxy) methyl phenyl methyl(meth)acrylate, m-(vinyloxy)methyl phenyl methyl(meth)acrylate, o-(vinyloxy)methyl phenyl methyl(meth)acrylate, 2-(vinyloxy ethoxy)ethyl(meth)acrylate, 2-(vinyloxy isopropoxy)ethyl(meth)acrylate, 2-(vinyloxy ethoxy)propyl(meth)acrylate, 2-(vinyloxy ethoxy)isopropyl(meth)acrylate, 2-(vinyloxy isopropoxy)propyl(meth) acrylate, 2-(vinyloxy isopropoxy)isopropyl(meth)acrylate, 2-(vinyloxy ethoxy ethoxy)ethyl(meth)acrylate, 2-(vinyloxy ethoxy isopropoxy)ethyl(meth)acrylate, 2-(vinyloxy isopropoxy ethoxy)ethyl(meth)acrylate, 2-(vinyloxy isopropoxy isopropoxy)ethyl(meth)acrylate, 2-(vinyloxy ethoxy ethoxy)propyl(meth)acrylate, 2-(vinyloxy ethoxy isopropoxy)propyl (meth)acrylate, 2-(vinyloxy isopropoxy ethoxy)propyl (meth)acrylate, 2-(vinyloxy isopropoxy isopropoxy)propyl (meth)acrylate, 2-(vinyloxy ethoxy ethoxy)isopropyl(meth) acrylate, 2-(vinyloxy ethoxy isopropoxy)isopropyl(meth) acrylate, 2-(vinyloxy isopropoxy ethoxy)isopropyl(meth) acrylate, 2-(vinyloxy isopropoxy isopropoxy)isopropyl (meth)acrylate, 2-(vinyloxy ethoxy ethoxy ethoxy)ethyl (meth)acrylate, 2-(vinyloxy ethoxy ethoxy ethoxy ethoxy) ethyl(meth)acrylate, 2-(isoproterenoxy ethoxy)ethyl(meth) acrylate, 2-(isoproterenoxy ethoxy ethoxy)ethyl(meth) acrylate, 2-(isoproterenoxy ethoxy ethoxy ethoxy)ethyl (meth)acrylate, 2-(isoproterenoxy ethoxy ethoxy ethoxy ethoxy)ethyl(meth)acrylate, polyethylene glycol monovinyl ether(meth)acrylate, and polypropylene glycol monovinyl ether(meth)acrylate.

Of the aforementioned, 2-(vinyloxy)ethyl(meth)acrylate, 3-(vinyloxy)propyl(meth)acrylate, 1-methyl-2-(vinyloxy) ethyl(meth)acrylate, 2-(vinyloxy)propyl(meth)acrylate, 4-(vinyloxy)butyl(meth)acrylate, 4-(vinyloxy)cyclohexyl (meth)acrylate, 5-(vinyloxy)pentyl(meth)acrylate, 6-(vinyloxy)hexyl(meth)acrylate, 4-(vinyloxy)methyl cyclohexyl methyl(meth)acrylate, p-(vinyloxy)methyl phenyl methyl (meth)acrylate, 2-(vinyloxy ethoxy) ethyl(meth)acrylate, 2-(vinyloxy ethoxy ethoxy)ethyl(meth)acrylate, and 2-(vinyloxy ethoxy ethoxy ethoxy)ethyl(meth)acrylate are preferable.

Of these, 2-(vinyloxy ethoxy)ethyl(meth)acrylate has low viscosity, a high flash point, and excellent curability, and is therefore preferable. Also, 2-(vinyloxy ethoxy)ethyl acrylate has low odor, is able to suppress skin irritation, and has excellent reactivity and adhesion, and is therefore further preferable.

Examples of 2-(vinyloxy ethoxy)ethyl(meth)acrylate include 2-(2-vinyloxy ethoxy)ethyl(meth)acrylate and 2-(1-vinyloxy ethoxy)ethyl(meth)acrylate, and examples of 2-(vinyloxy ethoxy)ethyl acrylate include 2-(2-vinyloxy ethoxy) ethyl acrylate and 2-(1-vinyloxy ethoxy)ethyl acrylate.

The monomer A is contained at 20 to 50 mass % per the total amount of the ink composition (100 mass %), preferably at 22 to 40 mass %. When the content is in the aforesaid range, the ink can be given favorable adhesion, scratch resistance, and alcohol resistance.

Examples of methods for producing the monomer A represented by the above General Formula I include, but are not limited to: a method in which a (meth)acrylic acid and a hydroxyl group-containing vinyl ether undergo esterification (production method B); a method in which a halogenated (meth)acrylate compound and a hydroxyl group-containing vinyl ether undergo esterification (production method C); a method in which a (meth)acrylic acid anhydride and a hydroxyl group-containing vinyl ether undergo esterification (production method D); a method in which an ester (meth) acrylate and a hydroxyl group-containing vinyl ether undergo transesterification (production method E); a method in which a (meth)acrylic acid and a halogen-containing vinyl ether undergo an esterification (production method F); a method in which an alkali (earth) metal salt (meth)acrylate and a halogen-containing vinyl ether undergo esterification (production method G); a method in which a hydroxyl group-containing (meth)acrylate ester and a vinyl carboxylate undergo a vinyl exchange (production method H); or a method in which a hydroxyl group-containing (meth)acrylate ester and an alkyl vinyl ether undergo an ether exchange (production method I).

Of these, the production method E can exert the desired effect in the present embodiment to a greater extent and is therefore preferable.

N-Vinyl Caprolactam

In the present embodiment, the N-vinyl caprolactam is a required polymerizable compound. Having the ink composition contain the N-vinyl caprolactam, in addition to the aforesaid monomer A, as a polymerizable compound gives the ink favorable adhesion, scratch resistance, and alcohol resistance.

The N-vinyl caprolactam is contained at 5 to 15 mass % per the total amount of the ink composition (100 mass %), preferably at 6 to 10 mass %. When the N-vinyl caprolactam content is within the aforesaid range, in addition to the monomer A content being in the range described above, the ink is given excellent adhesion, scratch resistance, and alcohol resistance.

Polymerizable Compounds Other than Above

Polymerizable compounds other than the above which are available for use (hereinafter "additional polymerizable compounds") include various conventional monomers and oligomers, which are monofunctional, bifunctional, trifunctional, and further multi-functional. Examples of such monomers include: (meth)acrylic acid, itaconic acid, crotonic acid, isocrotonic acid, maleic acid, and other unsaturated carboxylic acids and the salts or esters thereof; urethane; amides and the anhydrides thereof; acrylonitrile; styrene; various unsaturated polyesters; unsaturated polyethers; unsaturated polyamides; and unsaturated urethanes. Examples of such oligomers include: linear acrylic oligomers and other oligomers formed from the aforesaid monomers; epoxy(meth)acrylate; oxetane(meth)acrylate, aliphatic urethane(meth)acrylate, aromatic urethane(meth)acrylate and polyester(meth)acrylate.

An N-vinyl compound other than the N-vinyl caprolactam may also be included as an additional monofunctional monomer or multifunctional monomer. Examples of such an N-vinyl compound include: N-vinyl formamide, N-vinyl carbazole, N-vinyl acetamide, N-vinyl pyrrolidone, acryloyl morpholine, and the derivatives thereof.

Of the additional polymerizable compounds, esters of (meth)acrylic acid, i.e., (meth)acrylates are preferable, where multifunctional (meth)acrylates having two or more functional groups are more preferable and multifunctional acrylates are even more preferable. In particular, when the ink composition of the present embodiment further contains, as polymerizable compounds, a multifunctional acrylate in addition to the aforesaid predetermined amounts of the monomer A and the N-vinyl caprolactam, the ink composition is given excellent adhesion, scratch resistance, an alcohol resistance.

Of the aforesaid (meth)acrylates, examples of monofunctional (meth)acrylates include: isoamyl(meth)acrylate, stearyl(meth)acrylate, lauryl(meth)acrylate, octyl(meth) acrylate, decyl(meth)acrylate, isomyristyl(meth)acrylate, isostearyl(meth)acrylate, 2-ethylhexyl-diglycol(meth)acrylate, 2-hydroxybutyl(meth)acrylate, butoxyethyl(meth)acrylate, ethoxy diethylene glycol(meth)acrylate, methoxy diethylene glycol(meth)acrylate, methoxy polyethylene glycol (meth)acrylate, methoxy propylene glycol(meth)acrylate, phenoxy ethyl(meth)acrylate, tetrahydrofurfuryl(meth)acrylate, isobornyl(meth)acrylate, 2-hydroxyethyl(meth)acrylate, 2-hydroxypropyl(meth)acrylate, 2-hydroxy-3-phenoxypropyl(meth)acrylate, lactone modified flexible (meth)acrylate, t-butyl cyclohexyl(meth)acrylate, dicyclopentanyl (meth)acrylate, and dicyclopentenyloxyethyl(meth)acrylate.

Of the aforesaid (meth)acrylates, examples of multifunctional (meth)acrylates include: triethylene glycol di(meth) acrylate, tetraethylene glycol di(meth)acrylate, polyethylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonanediol di(meth)acrylate, neopentyl glycol di(meth)acrylate, dimethylol tricyclodecane di(meth)acrylate, a di(meth) acrylate of bisphenol A, hydroxy pivalic acid neopentyl glycol di(meth)acrylate, polytetramethylene glycol di(meth) acrylate, and other bifunctional (meth)acrylates; trimethylolpropane tri(meth)acrylate, glycerol propoxy tri(meth)acrylate, caprolactone-modified trimethylolpropane tri(meth) acrylate, di(trimethylolpropane)tetra(meth)acrylate, sorbitol penta(meth)acrylate; pentaerythritol tri(meth)acrylate, pentaerythritol tetra(meth)acrylate, pentaerythritol ethoxy tetra (meth)acrylate, and other (meth)acrylates having a pentaerythritol skeleton; dipentaerythritol hexa(meth)acrylate, caprolactam-modified dipentaerythritol hexa(meth)acrylate, dipentaerythritol penta(meth)acrylate, caprolactone-modified dipentaerythritol hexa(meth)acrylate, and other (meth) acrylates having a dipentaerythritol skeleton; propionic acid-modified tripentaerythritol penta(meth)acrylate, tripentaerythritol hexa(meth)acrylate, tripentaerythritol hepta(meth)acrylate, tripentaerythritol octa(meth)acrylate, and other (meth)acrylates having a tripentaerythritol skeleton; tetrapentaerythritol penta(meth)acrylate, tetrapentaerythritol hexa(meth)acrylate, tetrapentaerythritol hepta(meth)acrylate, tetrapentaerythritol octa(meth)acrylate, tetrapentaerythritol nona(meth)acrylate, tetrapentaerythritol deca(meth) acrylate, and other (meth)acrylates having a tetrapentaerythritol skeleton; and pentapentaerythritol undeca(meth)acrylate, pentapentaerythritol dodeca(meth) acrylate, and other (meth)acrylates having a pentapentaerythritol skeleton; as well as at least one of either the ethylene oxide (EO) adduct or propylene oxide (PO) adduct thereof, among other (meth)acrylates having three or more functional groups.

Of these, the additional polymerizable compounds preferably contain a multifunctional (meth)acrylate as described above. Among the multifunctional methacrylates, the aforesaid multifunctional (meth)acrylates having a pentaerythritol skeleton are preferable; at least one of pentaerythritol tri (meth)acrylate and pentaerythritol tetra(meth)acrylate is (are) more preferable; and at least one of pentaerythritol triacrylate and pentaerythritol tetraacrylate is (are) even more preferable. In the aforesaid case, the ink has decreased viscosity, and there will be an increase in cross-link density in the ink.

Among the monofunctional (meth)acrylates, phenoxy ethyl(meth)acrylate and isobornyl(meth)acrylate cause viscosity and odor to be reduced, and therefore at least one thereof is preferable; phenoxy ethyl(meth)acrylate is more preferable, and phenoxy ethyl acrylate is even more preferable.

One of the aforesaid additional polymerizable compounds may be used independently, or two or more may be used in combination.

The aforesaid additional polymerizable compound(s) may be contained at 5 to 50 mass % per the total amount of the ink composition (100 mass %). The multi-functional acrylates in particular have extremely excellent adhesion, scratch resistance, and alcohol resistance for the ink, and are therefore preferably contained at 5 to 20 mass % per the total amount of the ink composition (100 mass%), more preferably at 8 to 15 mass %.

Polymerization Inhibitor

The ink composition of the present embodiment may also contain a polymerization inhibitor. Examples of the polymerization inhibitor include, but are not particularly limited to: p-methoxy phenol, cresol, t-butyl catechol, di-t-butyl paracresol, hydroquinone monomethyl ether, α-naphthol, 3,5-di-t-butyl-4-hydroxy toluene, 2,2'-methylenebis(4-methyl-6-t-butylphenol), 2,2'-methylenebis(4-ethyl-6-butylphenol), 4'-thiobis(3-methyl-6-t-butylphenol), and other phenolic compounds; p-benzoquinone, anthraquinone, naphthoquinone, phenanthraquinone, p-xyloquinone, p-toluquinone, 2,6-dichloro-quinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-dibutyl hydroquinone, mono-t-butyl hydroquinone, monomethyl hydroquinone, 2,5-di-t-amyl hydroquinone, and other quinone compounds; phenyl-62 -naphthylamine, p-benzyl amino phenol, di-β-naphthyl para-phenylenediamine, dibenzyl hydroxylamine, phenyl hydroxylamine, diethyl hydroxylamine, and other amine compounds; dinitrobenzene, trinitrotoluene, picric acid, and other nitro compounds; quinone dioxime, cyclohexanone oxime, and other oxime compounds; and phenothiazine and other sulfur compounds.

Photopolymerization Initiator

The ink composition of the present embodiment preferably also contains a photopolymerization initiator. A photopolymerizable compound can also be used as the aforementioned polymerizable compound, whereby the addition of the photopolymerization initiator can be omitted. However, the initiation of polymerization can be more readily adjusted when a photopolymerization initiator is used, which is suitable.

The aforesaid photopolymerization initiator is used in order to cause the ink found on the surface of the recording medium to be cured by photopolymerization caused by the aforesaid irradiation with active light, thus forming an image. Herein, examples of the active light include gamma rays, beta rays, electron rays, ultraviolet (UV) rays, visible rays, and infrared rays. Ultraviolet rays are particular excellent in terms of safety and are such that the costs involved in the light source can be kept low, and are therefore employed in the present embodiment as described above. The photopolymerization initiator is not particularly limited, provided that the photopolymerization initiator generate radicals, cations, or other active species due to the energy of the light and thus initiate the polymerization of the aforesaid polymerizable compound(s); however, a photo-radical polymerization initiator or photo-cationic polymerization initiator can be used, it being preferable to use a photo-radical polymerization initiator.

Examples of the aforesaid photo-radical polymerization initiator include: aromatic ketones, acyl phosphine oxide compounds, aromatic onium salt compounds, organic peroxides, thio compounds (thioxanthone compounds, thiophenyl group-containing compounds, and the like), hexaarylbiimidazole compounds, ketoxime ester compounds, borate compounds, azinium compounds, metallocene compounds, active ester compounds, compounds having a carbon-halogen bond, and alkyl amine compounds.

Of these, acyl phosphine oxide compounds and thioxanthone compounds can render the ink particularly favorably curable, and therefore at least one thereof is preferable; both an acyl phosphine oxide compound and thioxanthone compound are more preferable.

Specific examples of photo-radical initiators include: acetophenone, acetophenone benzyl ketal, 1-hydroxycyclohexyl phenyl ketone, 2,2-dimethoxy-2-phenyl acetophenone, xanthone, fluorenone, benzoaldehyde, fluorene, anthraquinone, triphenylamine, carbazole, 3-methylacetophenone,4-chloro-benzophenone, 4,4'-dimethoxy benzophenone, 4,4'-di-amino benzophenone, Michler's ketone, benzoin propyl ether, benzoin ethyl ether, benzyl dimethyl ketal, 1-(4-isopropylphenyl)-2-hydroxy-2-methyl propane-1-one, 2-hydroxy-2-methyl-1-phenyl-propan-1-one, thioxanthone, diethyl thioxanthone, 2-isopropyl thioxanthone, 2-chlorothioxanthone, 2-methyl-1-[4-(methylthio)phenyl]-2-morpholino-propan-1-one, bis(2,4,6-trimethyl benzoyl)-phenyl phosphine oxide, 2,4,6-trimethylbenzoyl-diphenyl-phosphine oxide, 2,4-diethyl thioxanthone, and bis-(2,6-dimethoxy benzoyl)-2,4,4-trimethyl pentyl phosphine oxide.

Examples of commercially available photo-radical polymerization initiators include: IRGACURE 651 (2,2-dimethoxy-1,2-diphenyl-ethane-1-one), IRGACURE 184 (1-hydroxy-cyclohexyl-phenyl-ketone), DAROCUR 1173 (2-hydroxy-2-methyl-1-phenyl-propan-1-one), IRGACURE 2959 (1-[4-(2-hydroxy-ethoxy)-phenyl]-2-hydroxy-2-methyl-1-propane-1-one), IRGACURE 127 (2-hydroxy-1-{4-[4-(2-hydroxy-2-methyl-propionyl)-benzyl]phenyl]-2-methyl-propane-1-one}, IRGACURE 907 (2-methyl-1-(4-methyl thio phenyl)-2-morpholino propan-1-one), IRGACURE 369 (2-benzyl-2-dimethylamino-1-(4-morpholino phenyl)-butanone-1), IRGACURE 379 (2-(dimethyl amino)-2-[(4-methylphenyl)methyl]-1-[4-(4-morpholinyl) phenyl]-1-butanone), DAROCUR TPO (2,4,6-trimethyl benzoyl-diphenyl-phosphine oxide), IRGACURE 819 (bis(2,4,6-trimethyl benzoyl)-phenyl phosphine oxide), IRGACURE 784 (bis(η5-2,4-cyclopentadiene-1-yl)-bis(2,6-difluoro-3-(1H-pyrrol-1-yl)-phenyl)titanium), IRGACURE OXE 01 (1.2-octane-dione, 1-[4-(phenylthio)-, 2-(O-benzoyl oxime)]), IRGACURE OXE 02 (ethanone, 1-[9-ethyl-6-(2-methylbenzoyl)-9H-carbazol-3-yl]-, 1-(O-acetyl oxime)), IRGACURE 754 (a mixture of oxyphenylacetic acid, 2-[2-oxy-2-phenyl acetoxyethoxy]ethyl ester, and oxyphenylacetic acid, 2-(2-hydroxyethoxy)ethyl ester) (the preceding being made by BASF), Speedcure TPO (made by Lambson), KAYACURE DETX-S (2,4-diethyl thioxanthone) (made by Nippon Kayaku Co., Ltd.), Lucirin TPO, L 8893, LR 8970 (the preceding being made by BASF), and Uvecryl P36 (made by UCB).

One of the aforesaid additional photopolymerization initiators may be used independently, or two or more may be used in combination.

The photopolymerization initiator is preferably contained at 5 to 20 mass % per the total amount of the ink composition (100 mass%) in order for the radiation curing speed to be adequately demonstrated and for residues of the dissolved photopolymerization initiator and any coloring originating therefrom to be avoided.

In particular, in the case where, as described above, the photopolymerization initiator contained in the ink composition is an acyl phosphine oxide compound and a thioxanthone compound, then the acyl phosphine oxide compound is preferably contained at 7.0 mass % or more per the total amount of the ink composition (100 mass %), more preferably 7.0 to 15.0 mass %. In addition, the thioxanthone compound is preferably contained at 0.3 mass % or more per the total amount of the ink composition (100 mass%), more preferably 0.5 to 4.0 mass %. In such a case, the ink can be given extremely favorable curability.

Color Material

The ink composition of the present embodiment preferably further contains a color material. As the color material, one or more of either a pigment and a dye can be used.

Pigment

A pigment can be used as the color material in the present embodiment, whereby the ink composition can be given favorable light resistance. Either one of an inorganic pigment or an organic pigment can be used as the pigment.

As an inorganic pigment, it is possible to use furnace black, lamp black, acetylene black, channel black, and other carbon blacks (C.I. pigment black 7); iron oxide; or titanium oxide.

Examples of organic pigments include: insoluble azo pigments, condensed azo pigments, Azo Lake, chelate azo pigments, and other azo pigments; phthalocyanine pigments, perylene and perinone pigment, anthraquinone pigments, quinacridone pigments, dioxane pigments, thioindigo pigments, isoindolinone pigments, quinophthalone pigments, and other polycyclic pigments; dye chelate (for example, basic dye type chelate, acid dye type chelate, and the like); nitro pigments; nitroso pigments; aniline black; and daylight fluorescent pigments.

More specific examples of carbon blacks used as black inks include: No. 2300, No. 900, MCF88, No. 33, No. 40, No. 45, No. 52, MA7, MA8, MA100, No. 2200B, and the like (Mitsubishi Chemical); Raven 5750, Raven 5250, Raven 5000, Raven 3500, Raven 1255, Raven 700, and the like (Carbon Columbia); Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (CABOT JAPAN); or Color Black FW1, Color Black FW2, Color Black FW2V, Color Black FW18, Color Black FW200, Color Black S150, Color Black S160, Color Black S170, Printex 35, Printex U, Printex V, Printex140U, Special Black 6, Special Black 5, Special Black 4A, and Special Black 4 (Degussa).

Examples of pigments used as white inks include C.I. Pigment White 6, 18, and 21.

Examples of pigments used in yellow inks include: C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of pigments used in magenta inks include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, and 245, or C.I. Pigment Violet 19, 23, 32, 33, 36, 38, 43, and 50.

Examples of pigments used in cyan inks include: C.I. Pigment Blue 1, 2, 3, 15, 15:1, 15:2, 15:3, 15:34, 15:4, 16, 18, 22, 25, 60, 65, 66 or C.I. Vat Blue 4 or 60.

Further examples of pigments other than magenta, cyan, and yellow include: C.I. Pigment Green 7 or 10; C.I. Pigment Brown 3, 5, 25, or 26; and C.I. Pigment Orange 1, 2, 5, 7, 13, 14, 15, 16, 24, 34, 36, 38, 40, 43, or 63.

One of the aforesaid pigments may be used independently, or two or more may be used in combination.

In the case where an aforesaid pigment is used, the mean particle diameter thereof is preferably no greater than 300 nm, more preferably 50 nm to 250 nm. When the mean particle diameter is within the aforesaid range, the ink composition can be given even more excellent discharge safety, dispersion safety, and other aspects of reliability, and an image having excellent image quality can be formed. Herein, the mean particle diameter in the present embodiment is measured by a dynamic light scattering method.

Dye

A dye can be used as a coloring material in the present embodiment. The dye is not particularly limited, and acidic dyes, direct dyes reactive dyes, and basic dyes are available for use. Examples of the aforesaid dyes include: C.I. Acid Yellow 17, 23, 42, 44, 79, or 142; C.I. Acid Red 52, 80, 82, 249, 254, or 289; C.I. Acid Blue 9, 45, or 249; C.I. Acid Black 1, 2, 24, or 94; C.I. Food Black 1 or 2; C.I. Direct Yellow 1, 12, 24, 33, 50, 55, 58, 86, 132, 142, 144, or 173; C.I. Direct Red 1, 4, 9, 80, 81, 225, or 227; C.I. Direct Blue 1, 2, 15, 71, 86, 87, 98, 165, 199, or 202; C.I. Direct Black 19, 38, 51, 71, 154, 168, or 171, 195; C.I. Reactive Red 14, 32, 55, 79, or 249; and C.I. Reactive Black 3, 4, or 35.

One aforesaid dye may be used independently, or two or more may be used in combination.

The color material content is preferably 1 to 20 mass % per the total amount of the ink composition (100 mass %), in order to obtain excellent concealment and color reproducibility.

Dispersant

In the case where the ink composition of the present embodiment contains a pigment, a dispersant may be further contained in order for there to be more favorable pigment dispersion. Examples of a dispersant include but are not particularly limited to polymer dispersants and other dispersants customarily used to adjust pigment dispersion. Specific examples thereof include those primarily composed of one or more species from among: polyoxyalkylene polyalkylene polyamine, vinyl-based polymers and copolymers, acrylic-based polymers and copolymers, polyesters, polyamides, polyimides, polyurethane, amino-based polymers, silicon-containing polymers, sulfur-containing polymers, fluorine-containing polymers, and epoxy resins. Examples of commercially available polymer dispersants include: the Adisper series (Ajinomoto Fine-Techno); the Solsperse series (Solsperse 36000 and the like; Avecia); the Disperbyk series (BYK); or the Disperon series (Kasumoto Kasei).

Slip Agent

The ink composition of the present embodiment may further contain a slip agent (a surfactant) in order to obtain excellent scratch resistance. The slip agent is not particularly limited, but examples of silicone-based surfactants available for use include polyester-modified silicone and polyether-modified silicone; it is particularly preferable to use either polyether-modified polydimethylsiloxane or polyester-modified polydimethylsiloxane. Specific examples can include BYK-347, BYK-348, BYK-UV3500, 3510, 3530, and 3570 (BYK).

Additional Additives

The ink composition of the present embodiment may also contain additives (components) other than the additives listed above. Such components are not particularly limited, but possible examples include conventionally known polymerization promoters, penetration enhancers, and wetting agents (humectants), as well as other additives. Examples of other such additions include conventionally known fixing agents, antifungal agents, preservatives, antioxidants, radiation absorption agents, chelating agents, pH adjusting agents, and thickening agents.

When such an ink is used, the liquid droplet discharge head 49 will operate safely to discharge.

Figure 5A:
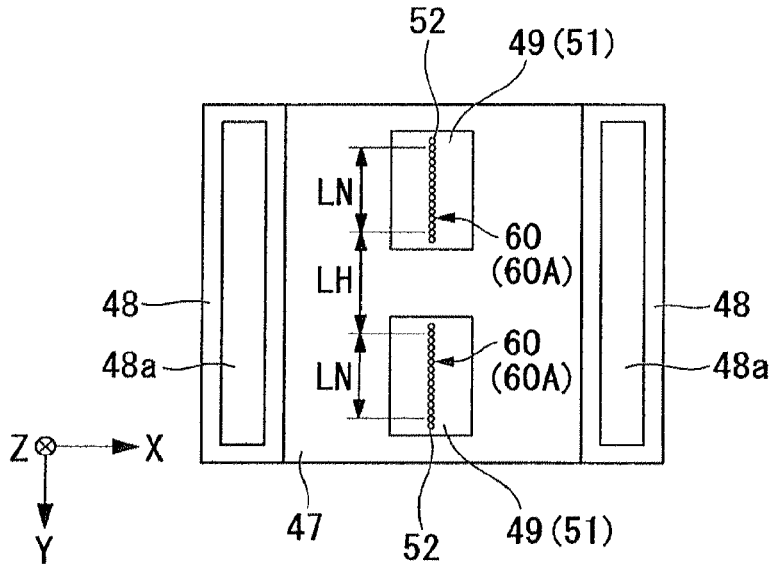
FIG. 5A is a schematic plan view illustrating a head unit.

FIG. 5A is a schematic plan view illustrating a head unit. As illustrated in FIG. 5A, two liquid droplet discharge heads 49 constituting a first and a second discharge head at arranged on the head unit 47 and create a gap in the secondary scanning direction; a nozzle plate 51 is arranged on the surface of each of the liquid droplet discharge heads 49. A plurality of nozzles 52 are formed in series on each of the nozzle plates 51. In the present embodiment, each of the nozzle plates 51 is provided with one nozzle column 60 in which 15 nozzles 52 are arranged along the secondary scanning direction. The two nozzle columns 60 are arranged in a linear manner along the Y direction and are arranged with regard to the X direction in positions equally spaced on both sides of the curing unit 48.

The nozzles 52 arranged at the two ends of the nozzle columns 60 in each of the liquid droplet discharge heads 49 trend toward having unsafe characteristics for discharging droplets and are therefore not used for liquid droplet discharge treatments. That is, in the present embodiment, 13 nozzles 52, excluding the two end nozzles 52, form an actual nozzle column 60A for discharging droplets onto the semiconductor substrate 1 in actual practice.

Herein, the adjacent liquid droplet discharge heads 49 are arranged in a positional relationship satisfying the following formula, where LN is the length in the secondary scanning direction of each of the actual nozzle columns 60A, and LH is the distance in the secondary scanning direction between the actual nozzle columns 60A of the respective adjacent liquid droplet discharge heads 49.

$$LH=n\times LN \text{ (}n\text{ is a positive integer)} \quad (1)$$

In the present embodiment, the two liquid droplet discharge heads 49 are arranged along the Y direction in a positional relationship where n=1, i.e., where LH=LN.

Irradiation ports 48*a* are formed on the lower surface of the curing unit 48. The irradiation ports 48*a* are provided so as to have an irradiation range at least as a long as the sum of the length of the discharge heads 49, 49 in the Y direction and the distance between the discharge heads 49, 49. Ultraviolet light emitted by the irradiation device is irradiated toward the semiconductor substrate 1 from the irradiation ports 48*a*.

Figure 5B:
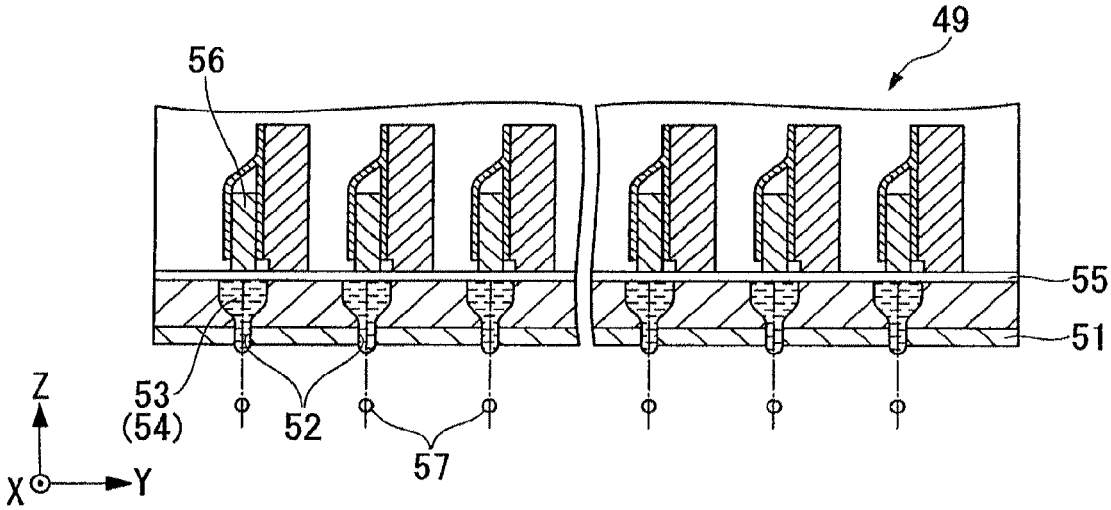
FIG. 5B is a schematic cross-sectional view for describing the structural elements of a liquid droplet discharge head.

FIG. 5B is a schematic cross-sectional view for describing the structural elements of the liquid droplet discharge head. As illustrated in FIG. 5B, the liquid droplet discharge head 49 is provided with the nozzle plate 51, and the nozzles 52 are formed on the nozzle plate 51. A cavity 53 communicating with the nozzles 52 is formed at a position on the upper side of the nozzle plate 51 and opposite the nozzles 52. The ink (liquid) 54 is supplied to the cavity 53 of the liquid droplet discharge head 49.

A vibration plate 55 for vibrating in the up-down direction to enlarge and reduce the volume inside the cavity 53 is installed on the upper side of the cavity 53. A piezoelectric element 56 for expanding and contracting in the up-down direction to cause the vibration plate 55 to vibrate is arranged at a point facing opposite the cavity 53 on the upper surface of the vibration plate 55. The piezoelectric element 56 expands and contracts in the up-down direction to apply pressure on and vibrate the vibration plate 55, and the vibration plate 55 enlarges and reduces the volume inside the cavity 53 to apply pressure on the cavity 53. The pressure inside the cavity 53 is thereby made to fluctuate, and the ink 54 having been supplied to the inside of the cavity 53 is discharged through the nozzles 52.

When the liquid droplet discharge head 49 receives a nozzle drive signal for controlling the drive of the piezoelectric element 56, the piezoelectric element 56 expands and the vibration plate 55 reduces the volume inside the cavity 53. Consequently, an amount of ink 54 equivalent to the reduction in volume is discharged as droplets 57 from the nozzles 52 of the liquid droplet discharge head 49. The semiconductor substrate 1, which has been coated with the ink 54, is irradiated with ultraviolet light from the irradiation ports 48*a*, and the ink 54, which contains a curing agent, is thus made to solidify or cure.

Housing Unit

Figure 6A:
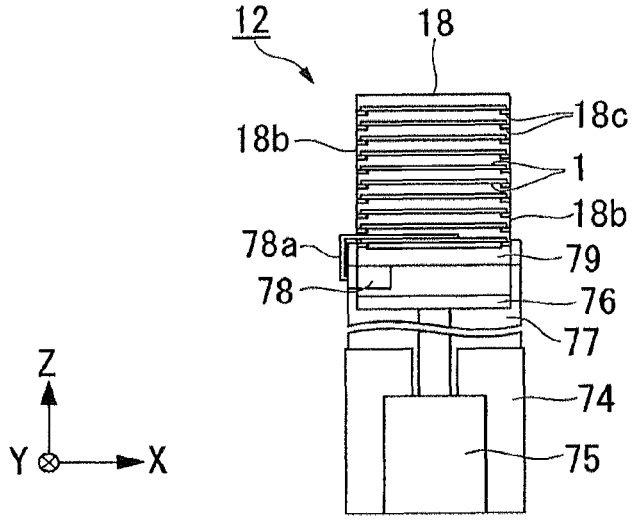
FIGS. 6A to 6C are schematic views illustrating a housing unit.
Figure 6B:
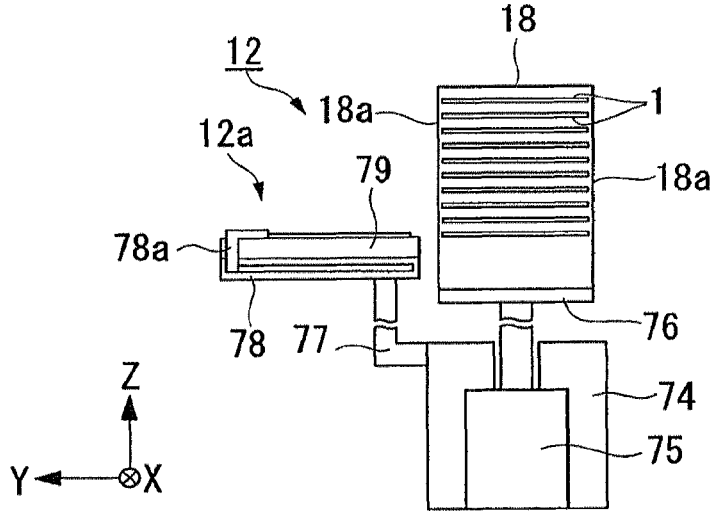
Figure 6C:
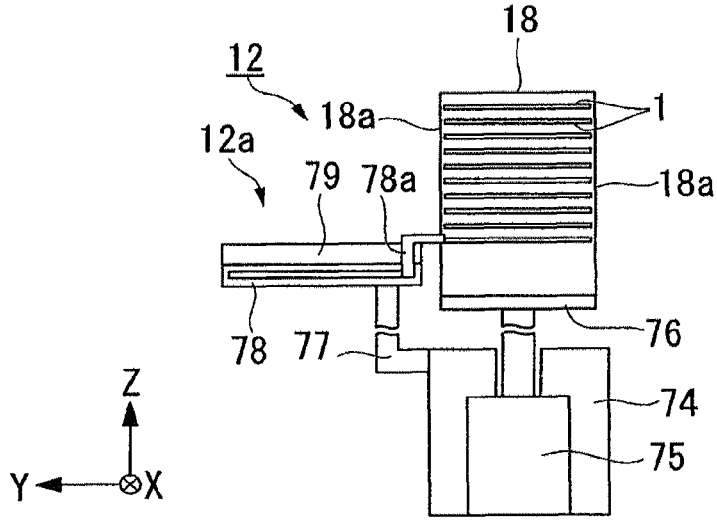

FIG. 6A is a schematic front view illustrating a housing unit, and FIGS. 6B and 6C are schematic side views illustrating a housing unit. As illustrated by FIGS. 6A and 6B, a housing unit 12 is provided with a base stage 74. A vertical motion device 75 is installed on the interior of the base stage 74. The vertical motion device 75 used can be a similar device to the vertical motion device 16 installed in the supply unit 8. A vertical motion plate 76 is installed on the upper side of the base stage 74 so as to be connected with the vertical motion device 75. The vertical motion plate 76 is lifted and lowered by the vertical motion device 75. A cuboid housing container 18 is installed on top of the vertical motion plate 76, and the semiconductor substrates 1 are housed within the housing container 18. The housing container 18 used is the same container as the housing container 18 installed in the supply unit 18.

A substrate pusher 78 and a relay stage 79 are installed via a support member 77 on the Y direction side of the base stage 74. The relay stage 79 is arranged at a point in the Y direction side of the housing container 18 so as to overlap onto the substrate pusher 78. The substrate pusher 78 is provided with an arm part 78*a* which moves in the Y direction, as well as with a linear movement mechanism for driving the arm part 78*a*. The linear movement mechanism is not particularly limited, that the linear movement mechanism be a mechanism for moving in a linear manner; the present embodiment employs an air cylinder operated by compressed air, by way of example. The semiconductor substrate 1 is mounted onto the relay stage 79 and an arm part 78*a* is allowed to make contact with the middle of one end of the Y direction side of the semiconductor substrate 1.

The substrate pusher 78 causes the arm part 78*a* to move in the −Y direction, whereby the arm part 78*a* causes the semiconductor substrate 1 to move in the −Y direction. The relay stage 79 has a concave part formed so as to have substantially the same width as the width in the X direction of the semiconductor substrate 1, and the semiconductor substrate 1 moves along the concave part. The position in the X direction of the semiconductor substrate 1 is determined by the concave part. Consequently, as illustrated in FIG. 6C, the semiconductor substrate 1 is made to move into the housing container 18. The rails 18*c* being formed in the housing container 18, the rails 18*c* are positioned on the line of extension of the concave part formed on the relay stage 79. The semiconductor substrate 1 is made to move along the rails 18*c* by the substrate pusher 78. The semiconductor substrate 1 is thereby safely housed in the housing container 18.

After the transport unit 13 has moved the semiconductor substrate 1 onto the relay stage 79, the vertical motion device 75 lifts the housing container 18. Then, the substrate pusher 78 drives the arm part 78*a* and moves the semiconductor substrate 1 into the housing container 18. The housing unit 12 thus houses the semiconductor substrate 1 in the housing container 18. After a predetermined number of semiconductor substrates 1 have been housed in a housing container 18, the operator replaces the housing container 18 in which the semiconductor substrates 1 have been housed with another empty housing container 18. The operator is thereby able to carry a plurality of semiconductor substrates 1 together in the following steps.

The housing unit 12 has a relay point 12*a* for mounting the housed semiconductor substrates 1. The transport unit 13 is able to cooperate with the housing unit 12 to house the semiconductor substrates 1 in the housing container 18 merely by mounting the semiconductor substrates 1 onto the relay point 12*a*.

Transport Unit

Figure 7:
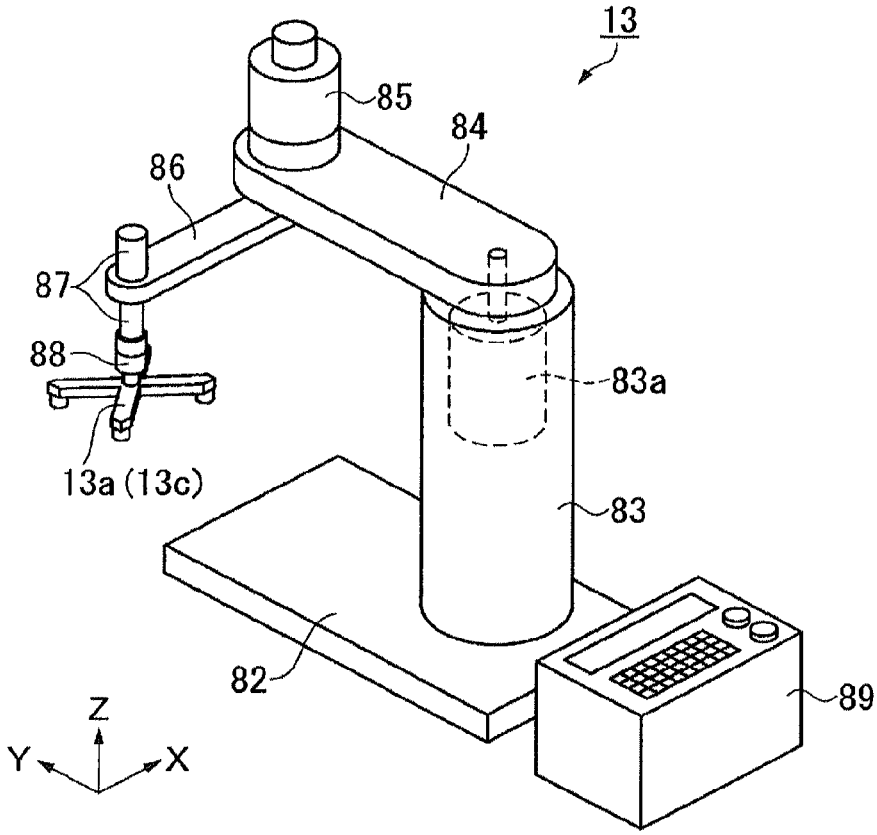
FIG. 7 is a schematic perspective view illustrating the configuration of a transport unit.

The following is a description of the transport unit 13 for transporting the semiconductor substrate 1, with reference to FIG. 7. FIG. 7 is a schematic perspective view illustrating the configuration of a transport unit. As illustrated in FIG. 7, the transport unit 13 is provided with a base stage 82 formed in a planar shape. A support stage 83 is arranged on the base stage 82. A hollow is formed in the interior of the support stage 83, and a rotation mechanism 83*a* constituted of a motor, an angle detector, a decelerator, and the like is installed in the hollow. The output shaft of the motor is connected to the decelerator, and the output shaft of the decelerator is connected to a first arm part 84 arranged on the upper side of the support stage 83. The angle detector is installed so as to be connected to the output shaft of the motor; the angle detector detects the angle of rotation of the output shaft of the motor. It is thereby possible to detect the angle of rotation of the first arm part 84 and to cause the rotation mechanism 83*a* to rotate at a desired angle.

A rotation mechanism 85 is installed at the end of the first arm part 84 on the side opposite to the support stage 83. The rotation mechanism 85 is constituted of a motor, an angle detector, a decelerator, and the like, and is provided with a similar function to that of the rotation mechanism installed inside the support stage 83. An output shaft of the rotation mechanism 85 is connected to a second arm part 86. It is thereby possible to detect the angle of rotation of the second arm part 86 and to cause the rotation mechanism 85 to rotate at a desired angle.

A vertical motion device 87 is arranged at the end of the second arm part 86 on the side opposite to the rotation mechanism 85. The vertical motion device 87 is provided with a linear movement mechanism, and expands and contracts by driving the linear movement mechanism. The linear movement mechanism used can be a similar mechanism to that of, for example, the vertical motion device 16 of the supply unit 8. A rotation device 88 is arranged on the lower side of the vertical motion device 87.

The rotation device 88, with the provision of being able to control the angle of rotation, can be constituted of the combination of any kind of motor with a rotational angle sensor. It is additionally possible to use a stepper motor capable of rotating the angle of rotation at a predetermined angle. The present embodiment employs a stepper motor, by way of example. A deceleration device may also be further arranged. Rotation at an even finer angle is thereby possible.

The gripping units 13*a* are arranged on the lower side of the rotation device 88 as shown. The gripping units 13*a* are connected to the rotating shaft of the rotation device 88. Accordingly, the gripping units 13*a* can be rotated by driving the rotation device 88. Further, the gripping units 13*a* can be raised and lowered by driving the vertical motion device 87.

The gripping units 13*a* have four finger parts 13*c* having linear shapes, and a chuck mechanism for suction-chucking the semiconductor substrate 1 is formed on the tips of the finger parts 13*c*. The gripping units 13*a* operate the chuck mechanism to be able to grip the semiconductor substrate 1.

A control device 89 is installed on the −Y direction side of the base stage 82. The control device 89 is provided with a central computation device, a memory unit, an interface, an actuator drive circuit, an input device, a display device, and the like. The actuator drive circuit is a circuit for driving the rotation mechanism 83*a*, the rotation mechanism 85, the vertical motion device 87, the vertical motion device 88, and the chuck mechanism of the gripping units 13*a*. These devices and the circuit are coupled to the central computation device via the interface. Additionally, the angle detectors are also coupled to the central computation device via the interface. The memory unit stores data used for controlling and program software indicating the operational sequence for controlling the transport unit 13. The central computation device is a device for controlling the transport unit 13 in accordance with the program software. The control device 89 inputs the output of the detectors arranged on the transport unit 13 and detects the position and orientation of the gripping units 13*a*. The control device also drives the rotation mechanism 83*a* and the rotation mechanism 85 to control such that the gripping units 13*a* are moved to predetermined positions.

Printing Method

Figure 8:
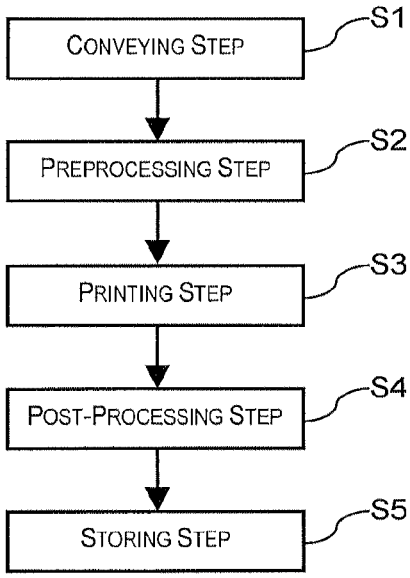
FIG. 8 is a flow chart illustrating a printing method.

The following is a description of the method for printing using the printing device 7 described above, with reference to FIG. 8. FIG. 8 is a flow chart for illustrating the printing method.

As illustrated in the flow chart in FIG. 8, the printing method is primarily constituted of: a conveying step S1, in which the semiconductor substrate 1 is introduced from the housing container 18; a preprocessing (pre-treatment) step S2, in which the surface of the introduced semiconductor substrate 1 is pre-treated; a printing step S3, in which various kinds of marks are drawn and printed onto the semiconductor substrate 1, having been heated in the preprocessing step S2; a post-processing (post-treatment) step S4, in which the semiconductor substrate 1, on which the various marks have been printed, undergoes post-treatment; and a storing step S5, in which the semiconductor substrate 1, having undergone the post-treatment, is housed in the housing container 18.

In the steps above, the steps from the preprocessing step S2 to the post-processing step S4 are features of the present invention, and therefore the following description describes these features. The present invention can also be applied in a case where the preprocessing step S2 is not performed.

In the preprocessing step S2, one stage of either the first stage 27 or the second stage 28 is positioned at the relay point 9*c* in the pre-treatment unit 9. The transport unit 13 moves the gripping units 13*a* to a point facing opposite the stage positioned at the relay point 9*c*. Subsequently, the transport unit 13, after having lowered the gripping units 13*a*, releases the chucking of the semiconductor substrate 1, whereby the semiconductor substrate 1 is mounted onto whichever of the first stage 27 or the second stage 28 is positioned at the relay point 9*c*. Consequently, the semiconductor substrate 1 is mounted onto the first stage 27 positioned at the relay point 9*c* (see FIG. 3B), or alternatively the semiconductor substrate 1 is mounted onto the second stage 28 positioned at the relay point 9*c* (see FIG. 3A).

The first stage 27 and the second stage 28 being pre-heated by the heating devices 27H, 28H, the semiconductor substrate having been mounted onto either the first stage 27 or the second stage 28 will immediately be heated to a predetermined temperature (120° C.).

When the transport unit 13 moves the semiconductor substrate 1 onto the first stage 27, the semiconductor substrate 1 that is on the second stage 28 is being pre-treated at the treatment point 9*d*, which is in the interior of the pre-treatment unit 9. Then, after the pre-treatment of the semiconductor substrate 1 on the second stage 28 is completed, the second stage 28 moves the semiconductor substrate 1 to the relay point 9*b*. Next, the pre-treatment unit 9 drives the first stage 27 and thereby moves the semiconductor substrate 1 mounted onto the first relay point 9*a* to the treatment point 9*d*, which is facing opposite the carriage 31. It is thereby possible to begin pre-treating the semiconductor substrate 1 that is on the first stage 27 immediately after the pre-treatment of the semiconductor substrate 1 that is on the second stage 28 has been completed.

Subsequently, the semiconductor device 3 installed onto the semiconductor substrate 1 is irradiated with ultraviolet light in the pre-treatment unit 9. Thereby, the chemical bonds in the organic materials to be irradiated in the surface layer of the semiconductor device 3 are severed, and the active oxygen separated from the ozone generated by the ultraviolet light binds to the severed molecules in the surface layer and are converted to highly hydrophilic functional groups (for example, —OH, —CHO, —COOH). The surface of the substrate 1 is thereby modified, and the organic matter in the surface is removed. Herein, the semiconductor device 3 (the semiconductor substrate 1), as has been described above, is irradiated with ultraviolet light in a state of having been pre-heated to 120° C., and therefore the semiconductor substrate 1 will not suffer any damage, and the molecules in the surface layer will collide at a higher rate; the surface can be effectively modified, and the organic matter in the surface can be effectively removed. After the pre-treatment has been performed, the pre-treatment unit 9 drives the first stage 27 and thereby moves the semiconductor substrate 1 to the relay point 9*a*.

Similarly, when the transport unit 13 moves the semiconductor substrate 1 onto the second stage 28, the semiconductor substrate 1 that is on the first stage 27 is being pre-treated at the treatment point 9*d*, which is in the interior of the pre-treatment unit 9. The first stage 27 moves the semiconductor substrate 1 to the relay point 9*a* after the pre-treatment of the semiconductor substrate 1 that is on the first stage 27 has been completed. Next, the pre-treatment unit 9 drives the second stage 28 and thereby moves the semiconductor substrate 1 having been mounted onto the second relay point 9*b* to the treatment point 9*d*, which is facing opposite the carriage 31. It is thereby possible to begin pre-treating the semiconductor substrate 1 that is on the second stage 28 immediately after the pre-treatment of the semiconductor substrate 1 that is on the first stage 27 has been completed. Subsequently, the pre-treatment unit 9 irradiates the semiconductor device 3 installed onto the semiconductor substrate 1 with ultraviolet light, whereby, similarly with respect to the aforesaid semiconductor substrate 1 that is on the first stage 27, the semiconductor substrate 1 will not suffer any damage; the surface can be effectively modified, and the organic matter in the surface can be effectively removed. After the pre-treatment has been performed, the pre-treatment unit 9 drives the second stage 28 and thereby moves the semiconductor substrate 1 to the relay point 9*b*.

After the pre-treatment of the semiconductor substrate 1 has been completed in the preprocessing step S2, the transport unit 13 transports the semiconductor substrate 1 that is at the relay point 9*c* to the stage 39 of the coating unit 10 provided to the relay point 10*a*. In the printing step S4, the coating unit 10 operates the chucking mechanism to retain, at the stage 39, the semiconductor substrate 1 having been mounted onto the stage 39.

At such a time, in the coating unit 10, the controller 14 drives the heating device 39H, whereby the mounting surface 41 is heated to 120° C. That is, the semiconductor substrate 1 is mounted onto the mounting surface 41 of the stage 39 in a state where the temperature having been heated by the pre-treatment unit 9 is retained. Accordingly, the coating step in the present embodiment can be performed on the mounting surface 41 while the temperature of the semiconductor substrate 1 is retained.

Specifically, the coating unit 10 discharges the droplets 57 from the nozzles 52 formed on each of the liquid droplet discharge heads 49 while also moving the carriage 45 scanning relative to the stage 39 in, for example, the +X direction (relative movement).

The ink landed on the semiconductor substrate 1, which has been heated to 120° C., is heated and thus has decreased viscosity, and spreads favorably onto the surface of the semiconductor substrate 1. In the present embodiment, the semiconductor substrate 1 is heated at 120° C., which is a higher temperature than the flash point of the monomers contained in the aforesaid ink, and therefore the monomers in the ink droplets landed on the semiconductor substrate 1 can be volatilized. The heating temperature is preferably at least 80° C., even more preferably at least 120° C. A preferable range for the heating temperature is 80° C. to 300° C., an even more preferable range being 120° C. to 200° C. The upper limit of the heating temperature is constrained by the heat resistance of the semiconductor substrate, but is preferably, for example, no higher than 300° C., more preferably no higher than 200° C.

Herein, the ink composition preferably contains a predetermined amount of N-vinyl caprolactam. In particular, heating N-caprolactam causes at least one of adhesion, scratch resistance, and alcohol resistance to be even more prominent, for which reason it is preferably contained in the ink composition. The N-vinyl caprolactam is contained in an amount of 5 to 15 mass %, and preferably 6 to 10 mass %, per the total amount of the ink composition (100 mass %). The ink composition preferably also contains monomer A. The monomer A is contained in an amount of 20 to 50 mass %, and preferably at 22 to 40 mass %, per the total amount of the ink composition (100 mass %). When the content is in the aforesaid range, the ink can be given excellent adhesion, scratch resistance, and alcohol resistance. Furthermore, when, in addition to the monomer A content being within the aforementioned range, the N-vinyl caprolactam content is also within the aforementioned range, then the ink will be given exceptional adhesion, scratch resistance, and alcohol resistance.

Figure 9:
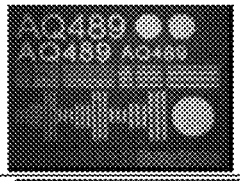
FIG. 9 is a drawing illustrating evaluation results.
Figure 9:
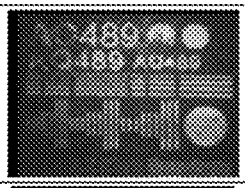
Figure 9:
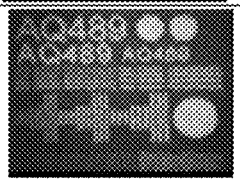
Figure 9:
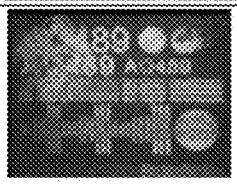
Figure 9:
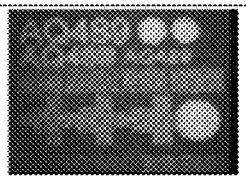
Figure 9:
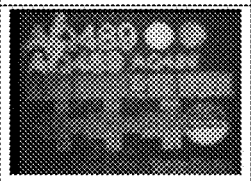
Figure 9:
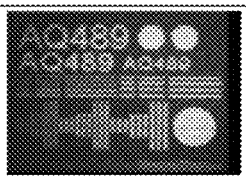
Figure 9:
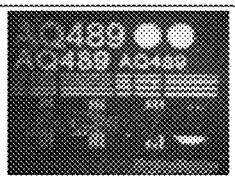

Herein, a description of the results from an evaluation relating to marks drawn onto semiconductor substrates 1 (semiconductor devices 3) using mounting surfaces 41 having different heating temperatures shall now be provided. FIG. 9 provides an illustration of the evaluation results. This evaluation was an evaluation of the visibility, scratch resistance, and solvent resistance (alcohol resistance) of the marks. The temperature of the ink discharged from the liquid droplet discharge heads in this evaluation was 40° C.

Visibility was evaluated macroscopically. The evaluation criteria were as follows. The symbols "◎" and "○" are evaluation criteria acceptable for practical use.

◎: No bleeding into the coating film.

○: Bleeding into some of the coating film, but not problematic for practical use.

Δ: Bleeding into some of the coating film; problematic for practical use.

×: Bleeding into the entire coating film; the mark is indiscernible.

Scratch resistance was evaluated through the use of a variable-load friction and wear testing system (Tribogear TYPE-HHS2000™; Shinto Scientific) to confirm the degree of peeling of the coating film. An image formed by solid printing with a 0.2-mm-diameter sapphire needle under a constant load was scratched, and the degree to which the coating film peeled was confirmed.

Solvent resistance (alcohol resistance) was evaluated by immersing the resulting printed articles in an isopropyl alcohol solution for one minute. Thereafter, the printed articles were removed from the solution and the degree to which the coating films peeled was confirmed under similar conditions to the scratch resistance evaluation.

The evaluation criteria for the scratch resistance and solvent resistance were as follows. The symbols "◎" and "○" are evaluation criteria acceptable for practical use.

◎: Coating film has no blemishes or peeling.

○: Some of the coating film has blemishes, but no observable peeling.

Δ: Some of the coating film has blemishes, and the coating film is peeling.

×: The entire coating film is blemished, and the coating film is peeling.

As illustrated in FIG. 9, in a case where the temperature of the heating device 39H for heating the mounting surface 41 was set to 120° C., it was successfully confirmed that favorable results were obtained for visibility, scratch resistance, and solvent resistance. In a case where the temperature of the heating device 39H for heating the mounting surface 41 was set to 80° C., it was successfully confirmed that scratch resistance and solvent resistance were modified. By contrast, in a case where the mounting surface 41 was not heated, although favorable visibility was confirmed, the results obtained for scratch resistance and solvent resistance were not favorable. This illustrates that the temperature for heating the semiconductor substrate 1 is very important, as described above. Specifically, this illustrates that the semiconductor substrate 1 necessarily must be set to at least the temperature at which the monomers in the ink droplets can be volatilized, i.e., at least the flash point of the monomers.

In the manner described above, the company name mark 4, the model code 5, the serial number 6, and other marks are drawn onto the surface of the semiconductor device 3. The marks are then irradiated with ultraviolet light from the curing unit 48 installed in the −X side of the carriage 45, which is the rear side in the scanning movement direction. Thereby, the surface of the marks is immediately solidified or cured, because the ink 54 for forming the marks contains the photopolymerization initiator(s) by which polymerization is started due to the ultraviolet light.

At such a time, because the two liquid droplet discharge heads 49 are arranged along the Y direction, which is the secondary scanning direction, and the nozzle columns 60 are arranged in a linear manner in the Y direction as well, the pinning time between when the droplets 57 are discharged onto the semiconductor device 3 until the droplets 57 are irradiated with ultraviolet light and cured will be identical between the two liquid droplet discharge heads 49, without there being any difference.

When the carriage 45 has finished its scanning movement in the +X direction, the stage 39 is, for example, fed a distance LN(=LH) in the +Y direction. As the carriage 45 is scanned (moved) relative to the stage 39 in the −X direction, the marks are then irradiated with ultraviolet light from the curing unit 48 installed in the +X side of the carriage 45, which is the rear side in the scanning movement direction, while the droplets 57 are discharged from the nozzles 52 formed on each of the liquid droplet discharge heads 49.

Thereby, the droplets are also discharged over the area between the two liquid droplet discharge heads 49 where no droplets would be discharged by a single scanning movement. Further, in the liquid droplet discharge by the second scanning movement, the pinning time between when the droplets 57 are discharged onto the semiconductor device 3 until when the droplets 57 are irradiated with ultraviolet light and cured will be identical between the two liquid droplet discharge heads 49, without there being any difference. Also, because the distance in the X direction between the nozzle columns 60 (the actual nozzle columns 60A) and the two sides of the curing unit 48 is identical, the pinning time will be identical between the liquid droplet discharge by the first scanning movement and the second scanning movement. In this manner, the printing step S3 is performed.

After the aforesaid printing step S3 has been completed, the post-processing step S4 is performed. Specifically, the controller 14 heats the heating device 39H at 180° C. and cures the marks drawn onto the semiconductor substrate 1 that is on the mounting surface 41. It is thereby possible to improve the friction resistance and other aspects of the marks relative to the semiconductor substrate 1.

After the semiconductor substrate 1 has been printed, the coating unit 10 moves the stage 39 on which the semiconductor substrate 1 is mounted to the relay point 10*a*. The transport unit 13 is thereby readily able to grip the semiconductor substrate 1. The coating unit 10 also halts the operation of the chucking mechanism and releases the retention of the semiconductor substrate 1.

Thereafter, during the storing step S5, the semiconductor substrate 1 is transported to the housing unit 12 by the transport unit 13 and then housed in the housing container 18.

As has been described above, according to the present embodiment, because the semiconductor device 3 onto which the ink is discharged has been heated, the landed ink droplets will have reduced viscosity and thus spread out favorably over the semiconductor device 3. In the present embodiment, the semiconductor device 3 is heated to at least 120° C., and therefore the monomers in the ink droplets spread out over the semiconductor device 3 can be volatilized. Thus, as has been illustrated by the evaluation results above, it is possible to print at high quality, with excellent scratch resistance and solvent resistance, less bleeding, and favorable visibility.

The above description was given with regard to a preferred embodiment according to the present invention with reference to the accompanying drawings, but it will be appreciated that the present invention is not limited to the example. The various shapes, combinations, and the like of each of the illustrated constituent members have been described by way of example, and various different modifications are possible, on the basis of design requirements and the like, within a scope that does not depart from the essence of the present invention.

For example, although an ultraviolet curing ink is used in the above embodiment as UV ink, the present invention is not limited thereto; it is also possible to use various other active light curing inks for which visible light or infrared light can be used as the curing light.

Similarly with respect to the light source, it is possible to use various different active light light sources for illuminating with visible light or other active light, i.e., to use an active light source irradiation unit.

Herein, the "active light" in the present invention broadly includes, but is not particularly limited to, α-rays, γ-rays, X-rays, ultraviolet rays, visible rays, electron rays, and the like, provided that an energy capable of generating an initiating species in an ink can be imparted as a result of irradiation by the light. Ultraviolet rays and electron rays are preferred among these types of radiation in terms of curing sensitivity and device procurement; ultraviolet rays are particularly preferable. Accordingly, as in the present embodiment, an ultraviolet curing ink, which can be cured by being irradiated with ultraviolet light, is preferably used as the active light curing ink.

In the above embodiment, the coating unit 10 and the pre-treatment unit 9 have been provided separately, but the pre-treatment may also be executed within the coating unit 10. In such a case, the low-pressure mercury lamp 32 may be provided to a position that will not interfere with the carriage 45 and other elements in the coating unit 10. Then, the first stage 27 or second stage 28 of the pre-treatment unit 9 will double as the stage 39 of the coating unit 10. Accordingly, the number of heating devices can be reduced. In the above embodiment, the semiconductor device is transported to the coating unit 10 and the semiconductor substrate 1 is heated once the semiconductor substrate 1 has been heated and treated in the pre-treatment unit 9, but this operation can be consolidated. It is thereby possible to curtail the treatment time. For example, although the standby time until the predetermined temperature is reached is performed twice, it is thereby possible to lessen the standby time. Further, because the substrate is not transported between the pre-treatment and the act of coating, the temperature can be kept from decreasing between the pre-treatment and the act of coating. In such a case, the temperature at the time of the pre-treatment and the temperature at the time of the coating are preferably equivalent. "Equivalent" temperatures have, for example, a temperature difference no greater than 30° C.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing method comprising:

heating a first surface of a first mounting portion to a predetermined first temperature before a semiconductor device is mounted on the first surface of the first mounting portion;

mounting the semiconductor device on the first surface of the first mounting portion;

discharging droplets of a liquid curable by active light rays from a nozzle of a discharge head onto the semiconductor device mounted on the first surface of the first mounting portion while the semiconductor device is in a heated state; and irradiating the droplets on the semiconductor device mounted on the first surface of the first mounting portion using the active light rays; and prior to the discharging of the droplets, performing a surface treatment of the semiconductor device by irradiating the semiconductor device with ultraviolet rays, wherein the performing of the surface treatment includes heating a second mounting portion to a predetermined second temperature before the semiconductor device is mounted on the second mounting portion, mounting the semiconductor device on the second mounting portion, and irradiating the semiconductor device mounted on the second mounting portion with the ultraviolet rays while the semiconductor device is heated.

2. The printing method according to claim 1, wherein the discharging of the droplets includes discharging the droplets onto the semiconductor device while the semiconductor device mounted on the first surface of the first mounting portion is heated to at least 80° C.

3. The printing method according to claim 1, wherein the discharging of the droplets includes discharging the droplets onto the semiconductor device while the semiconductor device mounted on the first surface of the first mounting portion is heated to at least 120° C.

4. The printing method according to claim 1, wherein the predetermined first temperature is set to be equal to a temperature of the semiconductor device that is heated on the second mounting portion.

5. A printing device comprising:

a first mounting portion configured to mount a semiconductor device thereon;

a discharge head having a nozzle for discharging, onto the semiconductor device mounted on a first surface of the first mounting portion, droplets of a liquid curable by active light rays;

a first heating unit installed in the first mounting portion, and configured and arranged to heat the first surface of the first mounting portion to a predetermined first temperature before the semiconductor device is mounted on the first surface of the first mounting portion;

an irradiation unit configured and arranged to irradiate, using the active light rays, the droplets discharged onto the semiconductor device mounted on the first surface of the first mounting portion; and a surface treatment unit configured and arranged to irradiate the semiconductor device with ultraviolet rays to perform a surface treatment of the semiconductor device, wherein the surface treatment unit includes a second mounting portion configured to mount the semiconductor device thereon, a second heating unit installed in the second mounting portion, and configured and arranged to heat the second mounting portion to a predetermined second temperature before the semiconductor device is mounted on the second mounting portion, and a treatment portion configured to irradiate the semiconductor device mounted on the second mounting portion with the ultraviolet rays while the semiconductor device is heated.

6. The printing device according to claim 5, wherein the first heating unit is configured and arranged to heat the semiconductor device on the first surface of the first mounting portion to at least 80° C.

7. The printing device according to claim 5, wherein the first heating unit is configured and arranged to heat semiconductor device on the first surface of the first mounting portion to at least 120° C.

8. The printing device according to claim 5, wherein the predetermined first temperature is set to be equal to a temperature of the semiconductor device that is heated on the second mounting portion.

* * * * *